US008701718B1

(12) United States Patent
Turiello

(10) Patent No.: US 8,701,718 B1
(45) Date of Patent: Apr. 22, 2014

(54) EMERGENCY AIR SYSTEM AND METHOD OF A MARINE VESSEL

(71) Applicant: Anthony J. Turiello, Redwood City, CA (US)

(72) Inventor: Anthony J. Turiello, Redwood City, CA (US)

(73) Assignee: Rescue Air Systems, Inc., San Carlos, CA (US)

( * ) Notice: Subject to any disclaimer, the term of this patent is extended or adjusted under 35 U.S.C. 154(b) by 0 days.

(21) Appl. No.: 13/691,854

(22) Filed: Dec. 3, 2012

Related U.S. Application Data

(63) Continuation-in-part of application No. 12/410,484, filed on Mar. 25, 2009, which is a continuation-in-part of application No. 11/505,597, filed on Aug. 16, 2006, now Pat. No. 7,527,056.

(51) Int. Cl.
*A62B 7/02* (2006.01)
*F17D 1/04* (2006.01)

(52) U.S. Cl.
CPC .... *A62B 7/02* (2013.01); *F17D 1/04* (2013.01)
USPC ..... 141/2; 141/18; 141/98; 128/202.13; 128/205.25; 169/62

(58) Field of Classification Search
CPC ..... A62B 7/00; A62B 7/02; F17D 1/04
USPC ..... 141/1, 2, 4, 18, 98, 99; 128/202.13, 128/205.25; 169/62
See application file for complete search history.

(56) References Cited

U.S. PATENT DOCUMENTS

| | | | | | |
|---|---|---|---|---|---|
| 2,299,793 | A | * | 10/1942 | Cannaday et al. | 128/202.13 |
| 2,576,143 | A | | 11/1951 | Kochet et al. | |
| 4,265,238 | A | | 5/1981 | Swiatosz et al. | |
| 4,331,139 | A | * | 5/1982 | Popa | 128/202.13 |
| 4,380,187 | A | * | 4/1983 | Wicks | 454/342 |
| 4,467,796 | A | | 8/1984 | Beagley | |
| 4,781,252 | A | | 11/1988 | Wilburn et al. | |
| 4,786,239 | A | | 11/1988 | Eberhardt | |
| 4,862,931 | A | * | 9/1989 | Vella | 141/1 |
| 4,905,684 | A | * | 3/1990 | Heffer | 128/202.13 |
| 4,974,584 | A | * | 12/1990 | Goodnoe | 128/202.13 |
| 5,368,106 | A | | 11/1994 | Coughlin | |
| 5,464,065 | A | | 11/1995 | Kaylor | |
| 5,486,811 | A | | 1/1996 | Wehrle et al. | |
| 5,513,678 | A | * | 5/1996 | Schultz et al. | 141/4 |
| 5,517,982 | A | * | 5/1996 | Grivas | 128/200.24 |
| 5,570,685 | A | * | 11/1996 | Turiello | 128/202.13 |

(Continued)

OTHER PUBLICATIONS

National Fire Protection Association; National Fire Protection Association Standards on Self Contained Breathing Apparatus for Fire Fighters 1981 Edition; May 19, 1981; Dallas,Texas, USA.

*Primary Examiner* — Gregory Huson
*Assistant Examiner* — Nicolas A Arnett
(74) *Attorney, Agent, or Firm* — Raj Abhyanker, P.C.

(57) ABSTRACT

Disclosed is an emergency air system and method of a marine vessel. In one embodiment, a method of safety of a marine vessel includes affixing an emergency support system to the marine vessel. In addition, the method includes pressurizing the emergency support system of the marine vessel to facilitate an air extraction process through the marine vessel. The method also includes expediting the air extraction process from the emergency support system by including a rapid fill fitting to a fill panel to fill a breathable air apparatus.

20 Claims, 19 Drawing Sheets

(56) References Cited

U.S. PATENT DOCUMENTS

| | | | | |
|---|---|---|---|---|
| 5,575,340 | A | 11/1996 | William | |
| 5,617,922 | A | 4/1997 | Sundholm | |
| 5,720,659 | A * | 2/1998 | Wicks | 454/256 |
| 5,730,121 | A * | 3/1998 | Hawkins et al. | 128/205.25 |
| 5,800,260 | A * | 9/1998 | Kao | 454/370 |
| 5,857,525 | A | 1/1999 | Okamoto et al. | |
| 5,896,856 | A | 4/1999 | Frasier et al. | |
| 5,936,531 | A | 8/1999 | Powers | |
| 6,131,667 | A | 10/2000 | Jesadanon | |
| 6,279,571 | B1 | 8/2001 | Meckes | |
| 6,467,727 | B1 * | 10/2002 | De Felipe | 244/118.5 |
| 6,585,583 | B1 | 7/2003 | Chan | |
| 6,616,833 | B2 | 9/2003 | Lynch | |
| 6,629,542 | B2 * | 10/2003 | Carris et al. | 137/1 |
| 6,802,370 | B1 * | 10/2004 | Garigan et al. | 165/281 |
| 6,810,964 | B1 | 11/2004 | Arnot | |
| 6,832,952 | B2 * | 12/2004 | Faltesek et al. | 454/338 |
| 7,114,575 | B2 | 10/2006 | De Anda-Uribe et al. | |
| 7,527,056 | B2 * | 5/2009 | Turiello | 128/205.26 |
| 7,621,269 | B2 * | 11/2009 | Turiello | 128/204.21 |
| 7,673,629 | B2 * | 3/2010 | Turiello | 128/204.21 |
| 7,677,247 | B2 * | 3/2010 | Turiello | 128/205.26 |
| 7,694,678 | B2 * | 4/2010 | Turiello | 128/204.21 |
| 7,770,610 | B2 * | 8/2010 | Lisle | 141/54 |
| 7,823,609 | B2 * | 11/2010 | Wonders | 141/2 |
| 7,866,340 | B2 | 1/2011 | Mele | |
| 7,900,709 | B2 | 3/2011 | Kotliar | |
| 7,975,729 | B2 * | 7/2011 | Lisle | 141/2 |
| 8,122,656 | B1 | 2/2012 | Poulsen | |
| 8,170,734 | B2 | 5/2012 | Kaji | |
| 8,261,844 | B2 | 9/2012 | Itano et al. | |
| 8,292,223 | B2 | 10/2012 | Lamoree et al. | |
| 8,371,295 | B2 * | 2/2013 | Turiello | 128/202.13 |
| 8,375,948 | B2 * | 2/2013 | Turiello | 128/205.26 |
| 8,381,726 | B2 * | 2/2013 | Turiello | 128/205.26 |
| 8,413,653 | B2 * | 4/2013 | Turiello | 128/204.21 |
| 8,443,800 | B2 * | 5/2013 | Turiello | 128/204.21 |
| 2002/0066797 | A1 | 6/2002 | Taylor | |
| 2003/0105783 | A1 | 6/2003 | Oshima et al. | |
| 2003/0230415 | A1 | 12/2003 | Wilson et al. | |
| 2004/0188868 | A1 | 9/2004 | Washington et al. | |
| 2005/0012679 | A1 | 1/2005 | Karlov | |
| 2005/0126796 | A1 | 6/2005 | Sant Angelo | |
| 2006/0175067 | A1 | 8/2006 | Cover et al. | |
| 2007/0102167 | A1 | 5/2007 | Rousseau et al. | |
| 2007/0163578 | A1 * | 7/2007 | Lisle | 128/202.12 |
| 2008/0041376 | A1 * | 2/2008 | Turiello | 128/204.18 |
| 2008/0041377 | A1 * | 2/2008 | Turiello | 128/204.18 |
| 2008/0041379 | A1 * | 2/2008 | Turiello | 128/204.21 |
| 2008/0254690 | A1 | 10/2008 | Kishibata | |
| 2009/0071471 | A1 | 3/2009 | Cohen | |
| 2009/0178675 | A1 * | 7/2009 | Turiello | 128/202.13 |
| 2009/0283151 | A1 * | 11/2009 | Turiello | 137/14 |
| 2009/0314296 | A1 * | 12/2009 | Cannon | 128/205.25 |
| 2010/0031955 | A1 * | 2/2010 | Turiello | 128/200.24 |
| 2010/0032040 | A1 * | 2/2010 | Turiello | 137/861 |
| 2010/0065056 | A1 * | 3/2010 | Greter | 128/204.23 |
| 2010/0078183 | A1 | 4/2010 | Janik | |
| 2010/0084043 | A1 * | 4/2010 | Turiello | 141/1 |
| 2010/0089489 | A1 * | 4/2010 | Turiello | 141/2 |
| 2010/0132961 | A1 | 6/2010 | Sandford | |
| 2010/0154922 | A1 * | 6/2010 | Turiello | 141/2 |
| 2010/0218962 | A1 | 9/2010 | Robb et al. | |
| 2011/0017479 | A1 | 1/2011 | Kariya | |
| 2011/0030838 | A1 * | 2/2011 | Turiello | 141/1 |
| 2011/0147017 | A1 | 6/2011 | Saglam | |
| 2011/0155398 | A1 | 6/2011 | Holland et al. | |
| 2011/0284251 | A1 | 11/2011 | Couvee et al. | |
| 2011/0320072 | A1 | 12/2011 | Morvillo | |
| 2012/0003908 | A1 | 1/2012 | Klimpel et al. | |
| 2012/0012348 | A1 | 1/2012 | Gracik et al. | |
| 2012/0048577 | A1 | 3/2012 | Ball | |
| 2012/0186691 | A1 | 7/2012 | Bridges et al. | |

* cited by examiner

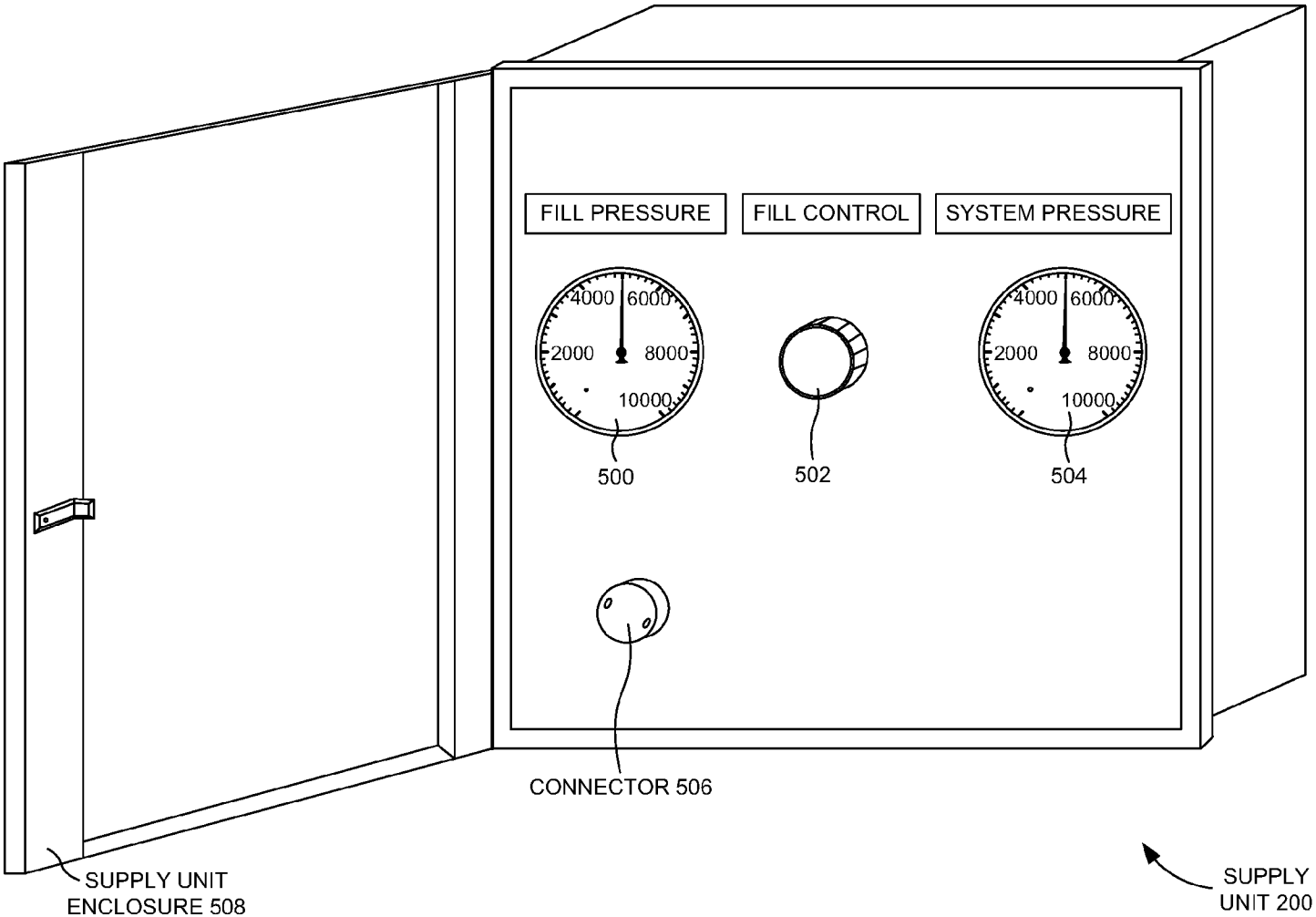
FIGURE 5A (FRONT VIEW)

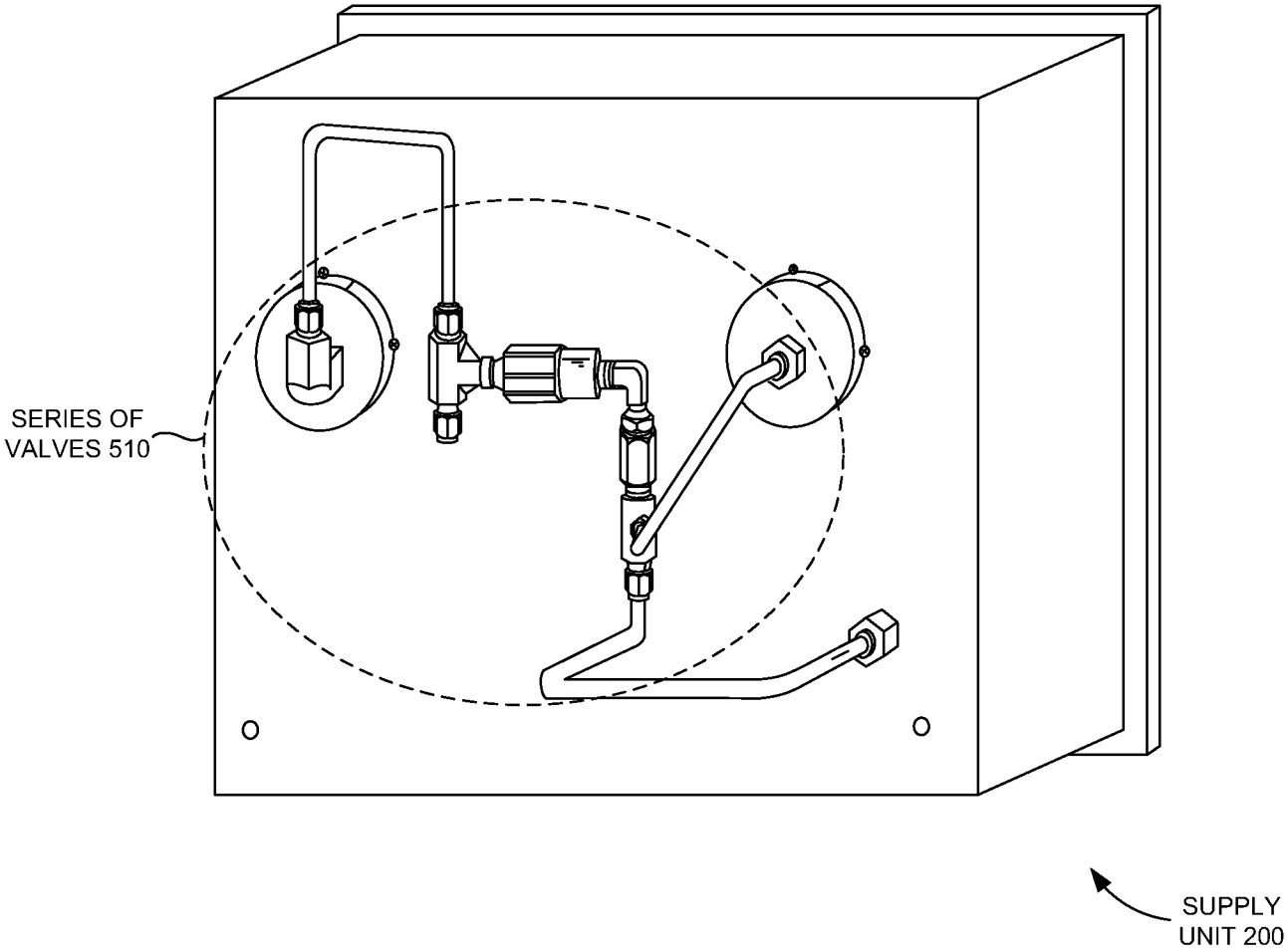
FIGURE 5B (REAR VIEW)

EMERGENCY AIR SYSTEM AND METHOD OF A MARINE VESSEL

FIELD OF TECHNOLOGY

This disclosure relates generally to a technical field of safety systems and, in one example embodiment, to a system, method and an apparatus of an emergency air system and method of a marine vessel.

BACKGROUND

Fighting fires on ships and/or marine vessels may present challenges that are different than fighting fires in buildings and/or other terrestrial structures. For example, when fighting a fire on a ship, fire fighting personnel may have to start on a deck of the ship and travel down to an interior and/or body of the ship, travelling against rising smoke. Additionally, ships may have many interconnected compartments in an interior the ship, which may increase time emergency personnel need to locate a source of the fire.

A method of extinguishing a fire onboard a ship may be to pour water on top of the ship, through a hose on the dock, a hose on another ship, and/or a helicopter. Such methods have limitations, including the viability of the water reaching the source of the fire. When water is poured on top of the ship, the water may be diverted through companion ways and/or ventilators without reaching the source of the fire. As a result, emergency personnel may be needed to extinguish the fire.

To extinguish a fire in the interior of a ship, emergency personnel may walk downwards into the interior. Walking into the interior of a ship during the fire may be a safety hazard to the emergency personnel, because the smoke and the toxic fumes may travel in the opposite direction, towards the emergency personnel. In such a situation, it may be important for the emergency personnel to access breathable air.

Additionally, a design of the interior of the ship may increase the difficulty of extinguishing a fire. The interior of a ship may comprise multiple interconnected compartments and/or chambers. Such a layout may increase the time to locate the source of the fire, which may increase a need of additional breathable air for firefighting personnel. Also, the layout may pose a health risk to passengers on the ship. The passengers may be exposed to smoke and toxic fumes as they navigate multiple corridors of the interior of the ship to seek an exit. Passengers may require breathable air, because it may take additional time to locate an exit.

Containing a fire on a ship may involve isolating the fire through a closure of one or more compartments such that the fire is confined to a specific area. The closure of the compartments may result in passengers and/or emergency personnel trapped in a confined area with limited access to breathable air. As a result, passengers aboard the marine vessel and/or emergency personnel may be subject to death and/or debilitating respiratory illnesses.

SUMMARY

Disclosed are a system, a method and an apparatus of an emergency air system and method of a marine vessel. In one aspect, a method of safety of a marine vessel includes affixing an emergency support system to the marine vessel. In addition, the method includes pressurizing the emergency support system of the marine vessel to facilitate an air extraction process through the marine vessel. The method also includes expediting the air extraction process from the emergency support system by including a rapid fill fitting to a fill panel to fill a breathable air apparatus. The rapid fill fitting may be a RIC (rapid interventions company/crew)/UAC (universal air connection) fitting. The method further includes maintaining the prescribed pressure of the emergency support system such that a system pressure is compatible with the breathable air apparatus through a distribution structure that is rated for use with compressed air that couples a supply unit and the fill panel to transfer the breathable air of a source of compressed air to the fill panel.

In addition, the method may include ensuring that a prescribed pressure of the emergency support system maintains within a threshold range of the prescribed pressure by including a valve of the emergency support system to prevent a leakage of a breathable air from the emergency support system. The method may also include distributing the fill panel within the marine vessel such that the fill panel is accessible in a compartment of the marine vessel and another fill panel is accessible in another compartment of the marine vessel. In addition, the method may include safeguarding the distribution structure and the fill panel such that an exposure of a salt and/or water to the distribution structure is reduced to minimize a rusting and/or a corrosion of the distribution structure and the fill panel. The method may further include calculating a buoyancy of the marine vessel comprising an air supply system based on a density of the air supply system to ensure that the marine vessel comprising the air supply system is stable in a marine environment. The air supply system may be a breathable air compressor and/or an air storage sub-system.

The method may include securing the fill panel such that the fill panel remains coupled to the marine vessel during a vibration of the marine vessel. The vibration may be a rocking motion of the marine vessel in response to a wave of the marine environment. The method may include automatically tracking and recording an impurity and a contaminant in the breathable air of the emergency support system through an air monitoring system. In addition, the method may include automatically suspending air dissemination to a fill site when an impurity level and/or a contaminant concentration exceed a safety threshold. The method may also include tracking and recording the system pressure of the emergency support system through a pressure monitoring system. The method may further include enclosing the supply unit with a robust metallic material such that the supply unit is protected from a physical damage. The robust metallic material may be substantially 18 gauge carbon steel.

In addition, the method may include enclosing the supply unit with a weather resistant feature, an ultraviolet and/or an infrared solar radiation resistant feature to prevent the corrosion and the physical damage. The method may also include enclosing the distribution structure with a fire rated material and/or a fire rated assembly such that the distribution structure has the ability to withstand an elevated temperature for a prescribed period of time. The method may further include protecting the fire rated material of the distribution structure through a sleeve. The sleeve may be three times an outer diameter of each of pipes of the distribution structure.

In addition, the method may include suspending a transfer of the breathable air from the source of compressed air to the emergency support system through the valve of the distribution structure when the distribution structure is exposed to a threat to prevent a compromise of the distribution structure. The method may also include providing an air supply enclosure made of a fire rated material and a breakable cover. The method may further include providing breathable air through the air supply enclosure when the breakable cover is compromised. The method may further include triggering an alarm when the breakable cover is compromised such that a security service and/or an emergency service are alerted. The method may also include providing a location in the marine vessel of the air supply enclosure to the security service and/or the emergency service.

In another aspect, a method of safety of a marine vessel includes affixing an emergency support system to the marine vessel. The method also includes pressurizing the emergency support system of the marine vessel to facilitate an air extraction process through the marine vessel. In addition, the method includes safeguarding a filling process of a breathable air apparatus through an enclosure of the breathable air apparatus in a secure chamber of a fill station of the emergency support system of the marine vessel to provide a safe placement to supply a breathable air to the breathable air apparatus. The method may further include maintaining the prescribed pressure of the emergency support system such that a system pressure is compatible with the breathable air apparatus through a distribution structure that is rated for use with compressed air that couples a supply unit and a fill panel to transfer the breathable air of a source of compressed air to the fill panel.

In addition, the method may include ensuring that a prescribed pressure of the emergency support system maintains within a threshold range of the prescribed pressure by including a valve of the emergency support system to prevent leakage of the breathable air from the emergency support system. The method may also include maintaining the prescribed pressure of the emergency support system such that a system pressure is compatible with the breathable air apparatus through a distribution structure that is rated for use with compressed air that couples the supply unit and the fill station to transfer the breathable air of the source of compressed air to the fill station.

The method may further include securing the breathable air apparatus to prevent the breathable air apparatus from injuring a user of the breathable air apparatus during the filling process of the breathable air apparatus. The method may also include adjusting a fill pressure to ensure that the fill pressure of the source of compressed air does not exceed the prescribed pressure of the emergency support system through a pressure regulator of the supply unit.

In yet another aspect, a system includes a marine vessel, an air storage sub-system coupled to the marine vessel to store a breathable air. In addition, the system includes a fitting to expedite an air extraction process from a supply unit to fill a breathable air apparatus. The fitting may be a RIC (rapid interventions company/crew)/UAC (universal air connection) fitting. In addition, the system also includes a fill panel to secure the fitting. The system further includes a distribution structure to connect the supply unit to the fitting. The system also includes a valve to maintain a prescribed pressure of an emergency support system such that a system pressure is compatible with the breathable air apparatus through the distribution structure that is rated for use with compressed air that couples the supply unit and the fill panel to transfer the breathable air of a source of compressed air to the fill panel.

The methods, systems and apparatuses disclosed herein may be implemented in any means for achieving various aspects, and may be executed in a form of a machine-readable medium embodying a set of instructions that, when executed by a machine, cause the machine to perform any of the operations disclosed herein. Other features will be apparent from the accompanying drawings and from the detailed description that follows.

BRIEF DESCRIPTION OF THE VIEWS OF DRAWINGS

Example embodiments are illustrated by way of example and not limitation in the figures of accompanying drawings, in which like references indicate similar elements and in which:

FIG. 5A is a front view of a supply unit, according to one or more embodiments.

FIG. 5B is a rear view of the supply unit, according to one or more embodiments.

Other features of the present embodiments will be apparent from accompanying Drawings and from the Detailed Description that follows.

DETAILED DESCRIPTION

Disclosed is an emergency air system and method of a marine vessel. It will be appreciated that the various embodiments discussed herein need not necessarily belong to the same group of exemplary embodiments, and may be grouped into various other embodiments not explicitly disclosed herein. In the following description, for purposes of explanation, numerous specific details are set forth in order to provide a thorough understanding of the various embodiments.

A marine vessel may be a vehicle, a craft, a container, and/or a barge designed to move across (or through) water, including saltwater and freshwater, for pleasure, recreation, physical exercise, commerce, transport and/or military missions. In one or more embodiments, the marine vessels may be classified based on usage. For example, a marine vessel used for exportation of goods may be called as a cargo ship, and a marine vessels used for fishing may be called as a fishing ship. In one or more embodiments, the marine vessels may include compartments. Examples of a compartment include, but are not limited to, an engine room, a dining facility, a galley, a mess hall, a cabin, a goods room and a gun turret. Embodiments described herein are directed to an air distribution system to provide breathable in a marine vessel 150.

Figure 1A:
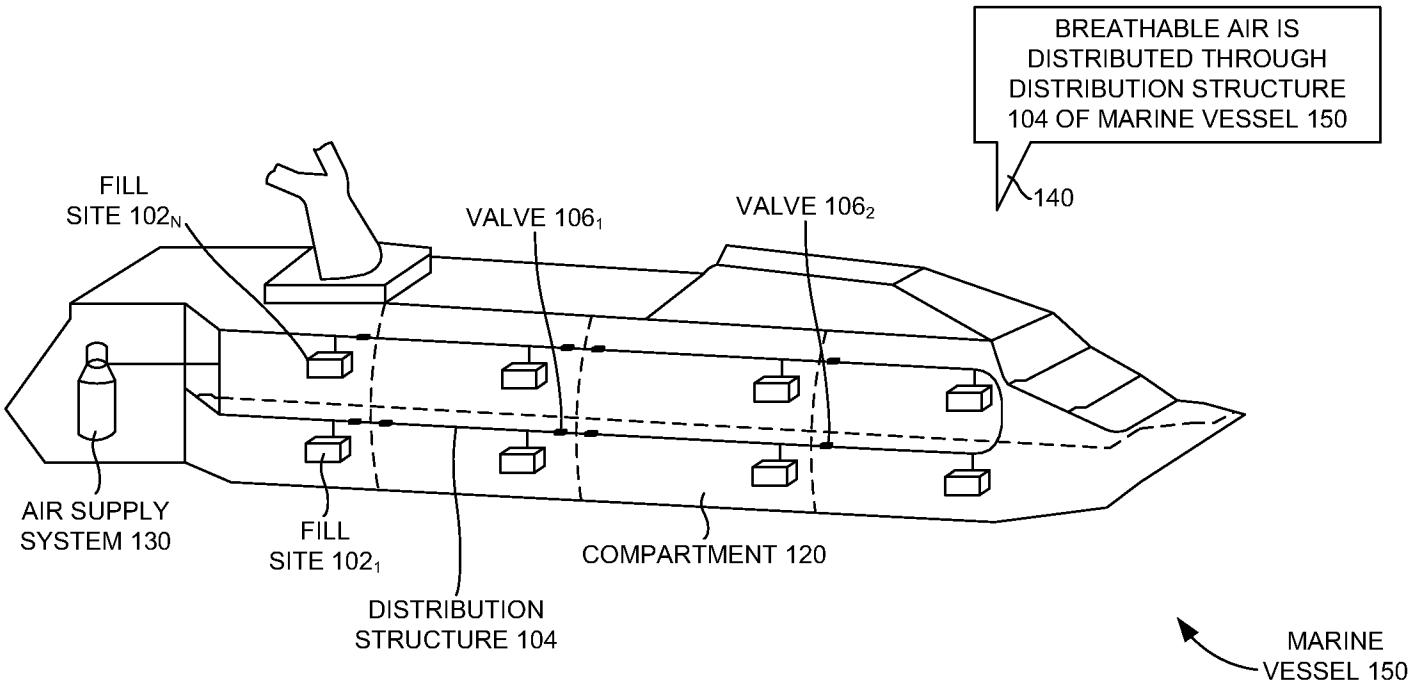
FIG. 1A is a system view of an air distribution system configured to distribute breathable air through a distribution structure of a marine vessel, according to one or more embodiments.
Figure 1B:
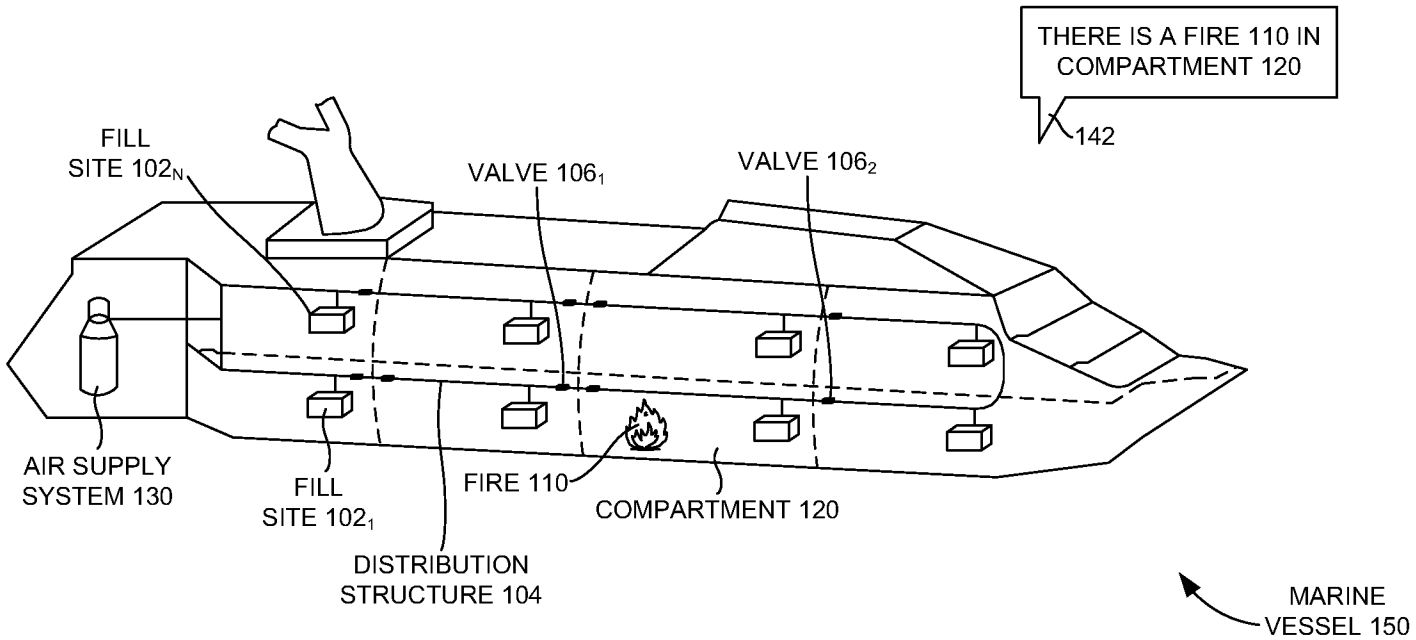
FIG. 1B is a system view that illustrates an emergency in the marine vessel, according to an example embodiment.
Figure 1C:
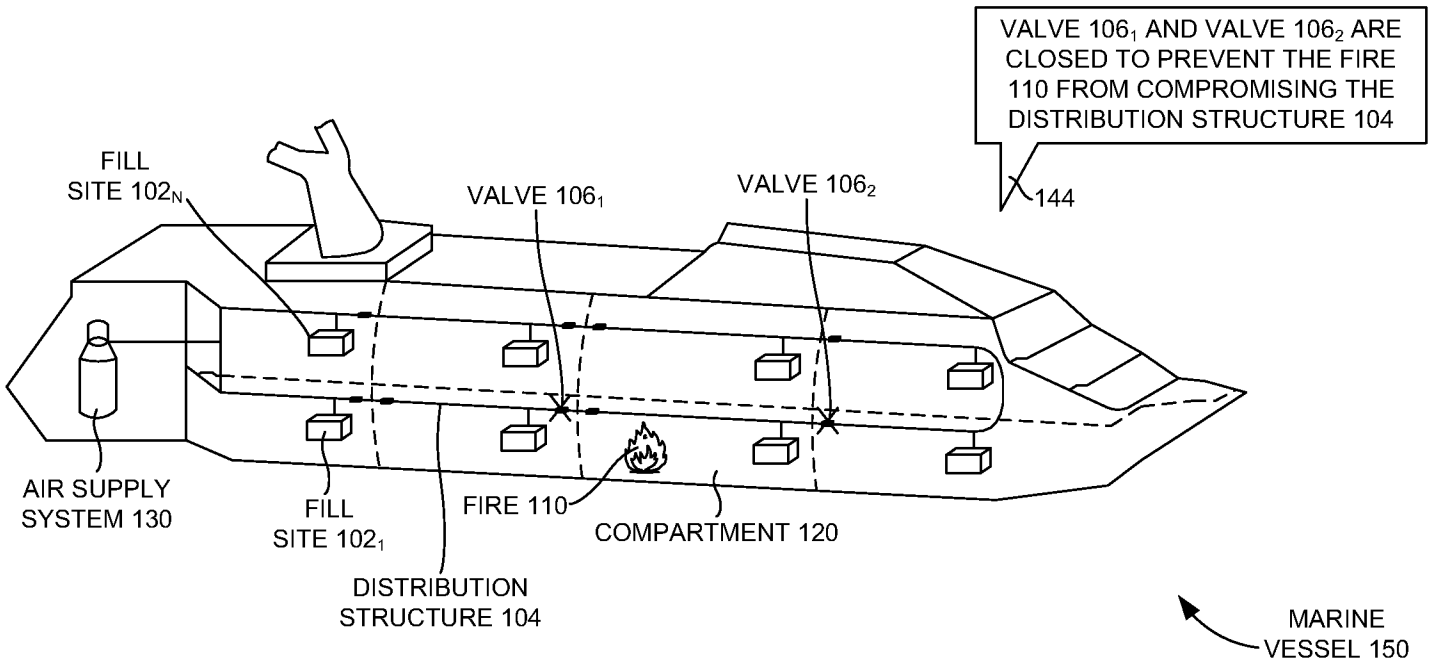
FIG. 1C is a system view that illustrates valves closed when the distribution system of the marine vessel was subjected to compromise due to direct contact with fire, according to an example embodiment.

FIGS. 1A-C illustrate the marine vessel 150 with an air distribution system to provide breathable air, according to one or more embodiments.

In one or more embodiments, the marine vessel 150 (e.g., transportation ship) may be designed with one or more compartments. Each compartment may/may not be separated from other compartments. In one or more embodiments, rescue operation during emergency (e.g., fire in the marine vessel 150) may be hampered due to the design of the compartments and the movements of the passengers/crew in the ship. In one or more embodiments, the marine vessel 150 as described herein may include an air supply system 130, a distribution structure 104, and fill sites $\mathbf{102}_{1\text{-}N}$ to provide breathable air to civilians, military personnel, staff, etc. during emergency until the civilians, military personnel, staff, etc, are rescued by the rescue staff. In one or more embodiments, the fill sites $\mathbf{102}_{1\text{-}N}$ may include an emergency support system affixed to the distribution structure 104 that is configured to provide supply of breathable air to the civilians, military personnel, and rescue staff.

Figure 7A:
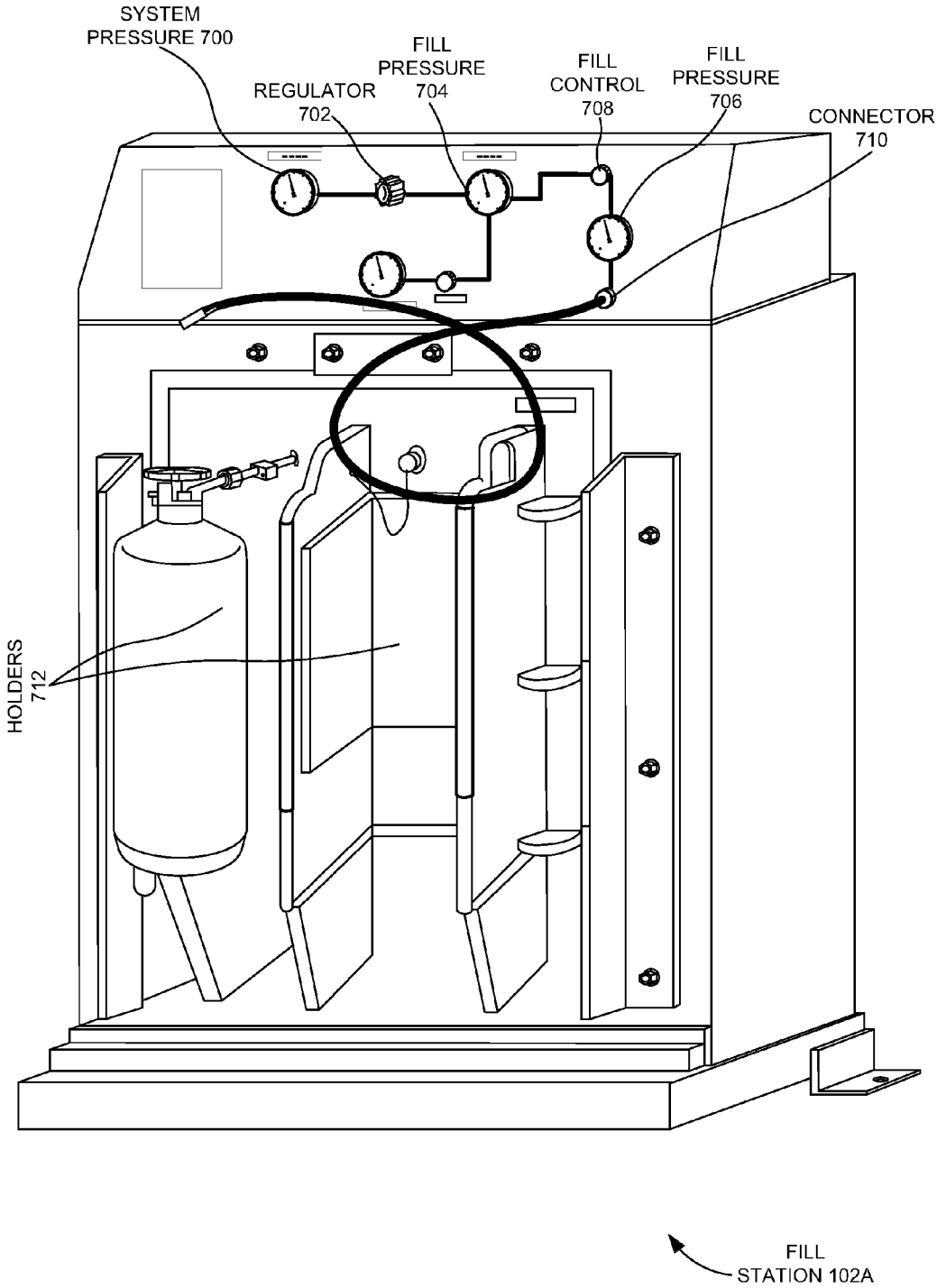
FIG. 7A is an illustration of a fill site, according to one embodiment.
Figure 7B:
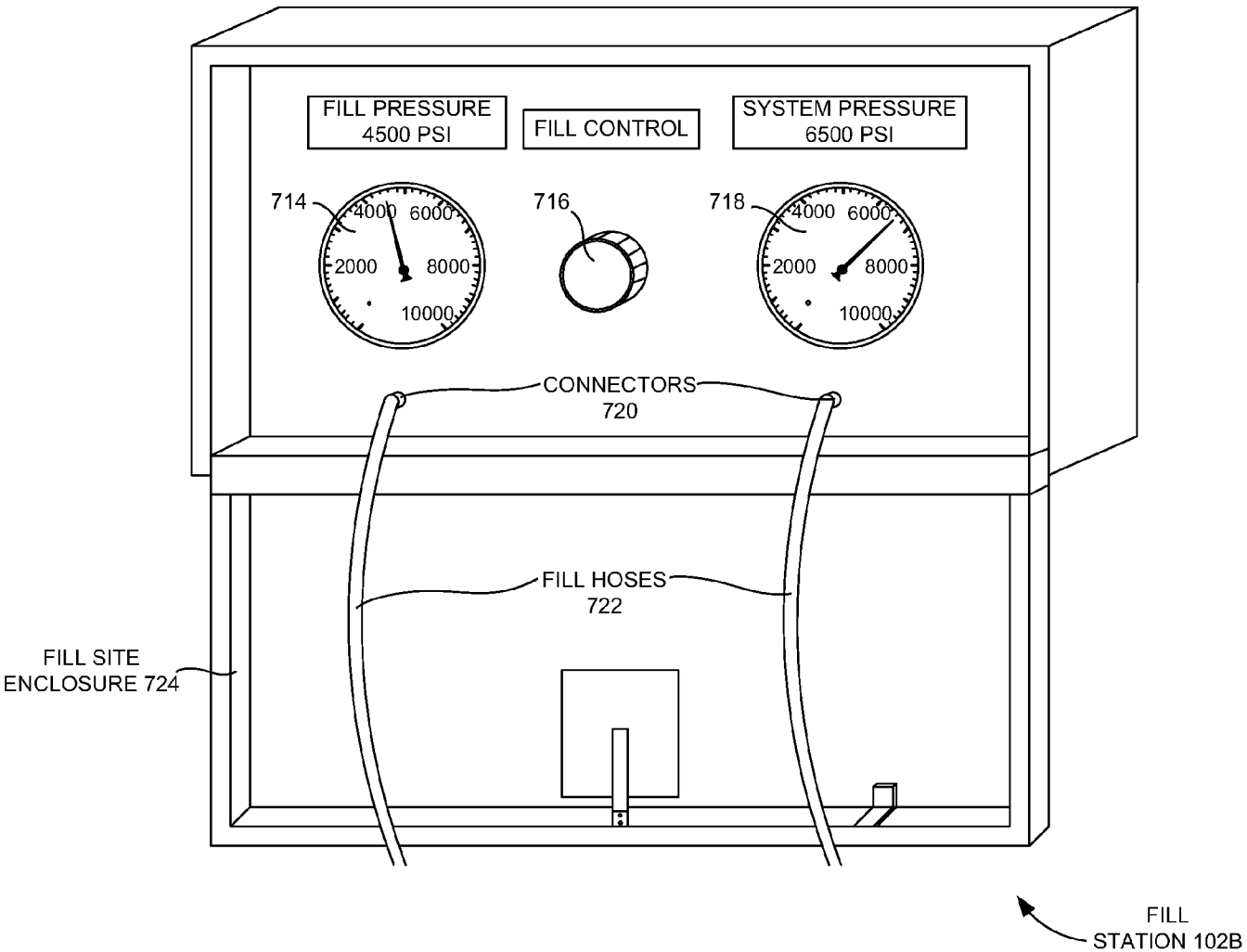
FIG. 7B illustrates a fill station, according to an alternate embodiment.
Figure 8B:
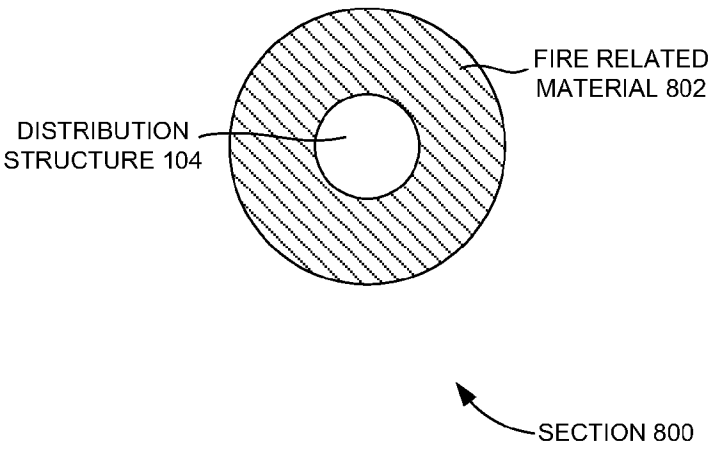
FIGS. 8A and 8B are diagram views of a distribution structure embedded in a fire rated material, according to one or more embodiments.
Figure 8A:
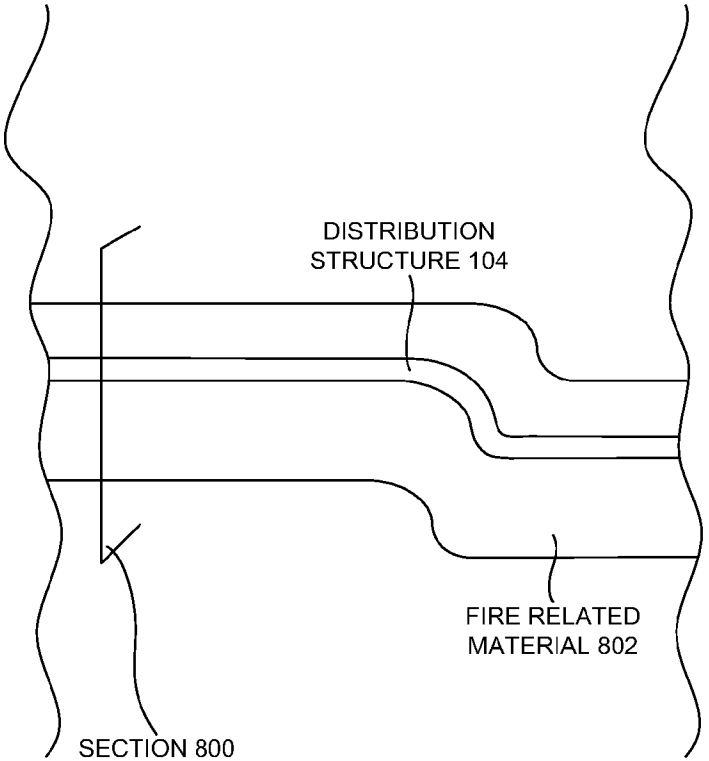

In one or more embodiments, the emergency support system of the marine vessel 150 may be pressurized to facilitate an air extraction process through the marine vessel 150. In one or more embodiments, the fill site $\mathbf{102}_{1\text{-}N}$ may include may include fill fittings, hoses and breathable apparatus to enable a civilians, military personnel, and rescue staff to extract breathable air from the distribution structure 104. In one or more embodiments, the breathable apparatus may be used by the rescue staff to extract breathable air from distribution structure 104 (e.g., as illustrated in FIG. 7). In one or more embodiments, a mask compatible to be used with the system at the fill site $\mathbf{102}_{1\text{-}N}$ may be made accessible to the civilians, military personnel, and rescue staff for using breathable air from the distribution structure 104. In one or more embodiments, a breathable mask (not shown in figure) may be coupled to the fill panel of the fill site $\mathbf{102}_{1\text{-}N}$ for extracting breathable air (e.g., as illustrated in FIGS. 8A and 8B). In or more embodiments, the mask may be designed such that the mask can be coupled to emergency support system of the fill site $\mathbf{102}_{1\text{-}N}$ to extract breathable air from the distribution structure 104 at a required pressure.

In one or more embodiments, the air supply system 130 may include one or more supply units, a control panel and other apparatuses that are required for receiving breathable air from an external supply, storing the breathable air at a prescribed pressure, and distributing the breathable at a prescribed pressure through the distribution structure 104 provided thereof. In one or more embodiments, the supply unit may be in a form of a storage that is used to store compressed breathable air at a prescribed pressure. In one or more embodiments, the air supply system 130 may be a breathable air compressor and/or an air storage sub-system.

In one or more embodiments, the distribution structure 104 as described herein may be designed to supply breathable air from the supply unit of the air supply system 130 to emergency support system at the fill sites $\mathbf{102}_{1\text{-}N}$ to support civilians, military personnel, support staff and rescue staff with breathable air when there is a lack of breathable air during the emergency. In one or more embodiments, the distribution structure 104 may be constructed using pipes connected through a series of valves $\mathbf{106}_{1\text{-}N}$. In one or more embodiments, the pipes may be designed to pass through every compartment of the ship. In one or more embodiments, the pipes are connected through the series of valves $\mathbf{106}_{1\text{-}N}$. In one or more embodiments, the distribution structure 104 used in the marine vessel 150 may be rated for use with compressed air that couples a supply unit (external to the marine vessel) and a fill panel to transfer the breathable air of a source of compressed air to the fill panel. In one or more embodiments, the valves $\mathbf{106}_{1\text{-}N}$ may be used as a part of the design of the distribution structure 104 to prevent a leakage of a breathable air from the emergency support system. In addition, the valves $\mathbf{106}_{1\text{-}N}$ may be used for ensuring that a prescribed pressure of the emergency support system maintains within a threshold range of the prescribed pressure.

Furthermore, in one or more embodiments, the breathable air in the distribution structure 104 may delivered to the rescue staff, civilians, and military personnel in any compartment through one or more fill sites $\mathbf{102}_{1\text{-}N}$. One or more fill sites $\mathbf{102}_{1\text{-}N}$ may be implemented in each of the compartments to provide rescue staff (e.g., firefighters) an access to the breathable air. In one or more embodiments, the fill sites $\mathbf{102}_{1\text{-}N}$ may be configured for the use by civilians and/or military personnel (e.g., as illustrated in FIGS. 8A-8B) or as a fill station for the use of filling breathable apparatus (e.g., as illustrated in FIGS. 7A-7B). Each of the fill sites $\mathbf{102}_{1\text{-}N}$ may include an emergency support system for extracting breathable air from the distribution structure 104. In addition, in one or more embodiments, the fill site $\mathbf{102}_{1\text{-}N}$ may include a rapid fill fitting to expedite the air extraction process from the emergency support system to fill the breathable air apparatus. In one or more embodiments, the rapid fill fitting may be a RIC (rapid interventions company/crew)/UAC (universal air connection) fitting. The rapid fill fitting may connect to a universal air connector. The rapid fill fitting may provide access to breathable air at a rate of at least 100 liters per minute.

In one or more embodiments, the fill site $\mathbf{102}_{1\text{-}N}$ may be secured such that the fill site $\mathbf{102}_{1\text{-}N}$ remains coupled to the marine vessel 150 during a vibration of the marine vessel 150. In one or more embodiments, the vibration may be a rocking motion of the marine vessel 150 in response to a wave of the marine environment. In one or more embodiments, a buoyancy of the marine vessel 150 including the air supply system 130 may be calculated based on a density of the air supply system to ensure that the marine vessel 150 that includes the air supply system 130 is stable in a marine environment.

In one or more embodiments, the air distribution system of the marine vessel 150 may include an air monitoring system configured to automatically track and recording impurities and a contaminants in the breathable air of the emergency support system. In one or more embodiment, the air monitoring system may include sensors such as CO/moisture sensor, suspended particle sensor, pressure sensor and other sensors to monitor the quality and pressure of breathable air in the system. In one or more embodiments, the air monitoring system may be configured to automatically suspend the air dissemination to the fill site $\mathbf{102}_{1\text{-}N}$ when an impurity level and a contaminant concentration exceeds a safety threshold.

Furthermore, in one or more embodiments, the air distribution system may include a pressure monitoring system of the air monitoring system configured to track and record the system pressure of the emergency support system. In one or more embodiments, a transfer of the breathable air from the source of compressed air to the emergency support system through the valve of the distribution structure 104 may be suspended when the distribution structure 104 is exposed to a threat to prevent a compromise of the distribution structure 104. In one or more embodiments, the valves may be configured to block a supply of breathable air when there is a threat that compromises the distribution structure 104 (e.g., as illustrated in FIG. 1C) at a relative point of threat.

In one or more embodiments, the air distribution system including the distribution structure 104 and the fill sites $\mathbf{102}_{1\text{-}N}$ may be safeguarded such that an exposure to a salt and water to the air distribution system is reduced to minimize a rusting and/or a corrosion of the distribution structure and the fill site. In one or more embodiments, the distribution structure 104 may also be enclosed in a fire rated material and/or a fire rated assembly such that the distribution structure 104 has the ability to withstand an elevated temperature for a prescribed period of time. Furthermore, in one or more embodiments, the distribution structure 104 may be protected using the fire rated material of the distribution structure 104 through a sleeve. In one or more embodiments, the sleeve may have dimensions of three times an outer diameter of each of the pipes of the distribution structure 104.

Also, the supply unit of the air supply system 130 may be enclosed with a robust metallic material such that the supply unit is protected from a physical damage. In one or more embodiments, the robust metallic material may be greater than or substantially 18 gauge carbon steel. Furthermore, the supply unit of the air supply system 130 may be enclosed with a weather resistant feature, an ultraviolet and/or an infrared solar radiation resistant feature (e.g., coating) to prevent the corrosion and the physical damage.

In one or more embodiments, a secure chamber may be provided enclosing the fill sites $\mathbf{102}_{1\text{-}N}$. In one or more embodiments, a filling process of a breathable air apparatus through an enclosure of the breathable air apparatus may be safeguarded in a secure chamber of a fill site of an emergency support system of the marine vessel 150 to provide a safe placement to supply a breathable air to the breathable air apparatus.

In one or more embodiments, an air supply enclosure may be designed at the file site $\mathbf{102}_{1\text{-}N}$ for providing breathable air to any person on board the marine vessel during an emergency. In one or more embodiments, breathable masks may be provided in the fill sites $\mathbf{102}_{1\text{-}N}$ to enable a person to intake breathable air from the emergency support system. In one or more embodiments, the air supply enclosure may include a breakable cover. In one or more embodiments, the breathable air may be accessed from the fill site $\mathbf{102}_{1\text{-}N}$ by compromising the breakable cover of the air supply enclosure. The breakable cover may be coupled to an electronic device (e.g., sensor-switch combination) to trigger an alarm when the breakable cover of the air supply enclosure is compromised. Also, in one or more embodiments, a security service (e.g., vessel guards, costal patrol) and emergency service (e.g., rescue staffs, medical professionals) may be alerted when the alarm is triggered.

In one example embodiment, FIG. 1A illustrates the air distribution system configured to distribute breathable air through a distribution structure 104 of the marine vessel 150. FIG. 1B illustrates an emergency situation that illustrates an accidental fire 110 in a compartment 120 of the marine vessel 150. FIG. 1C illustrates valves $\mathbf{106}_1$ and $\mathbf{106}_2$ blocked when the pipe in compartment 120 of the marine vessel 150 was subjected to compromise due to contact with fire.

Figure 2:
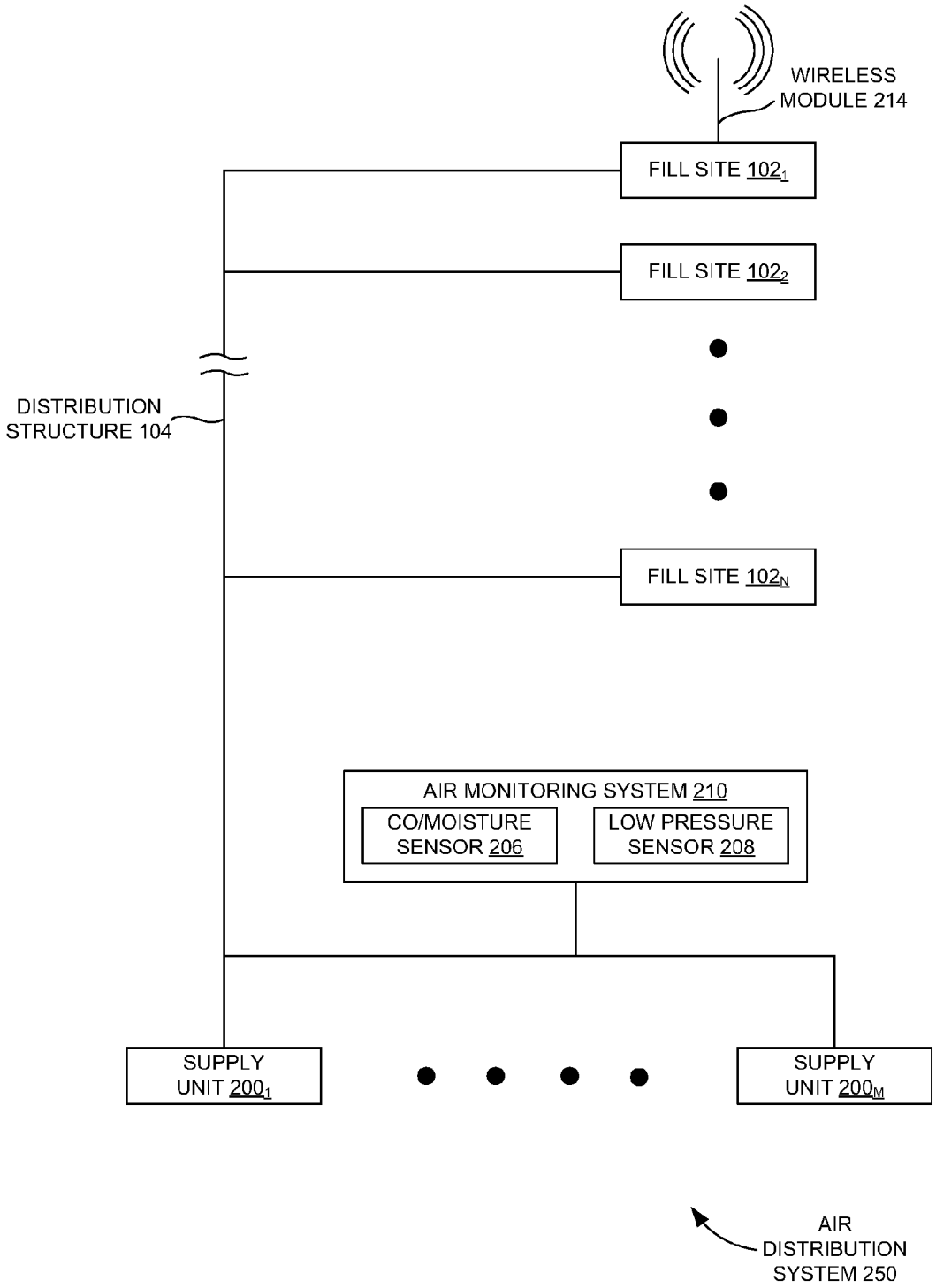
FIG. 2-3 are system views of the air distribution system, according to one or more embodiments.
Figure 3:
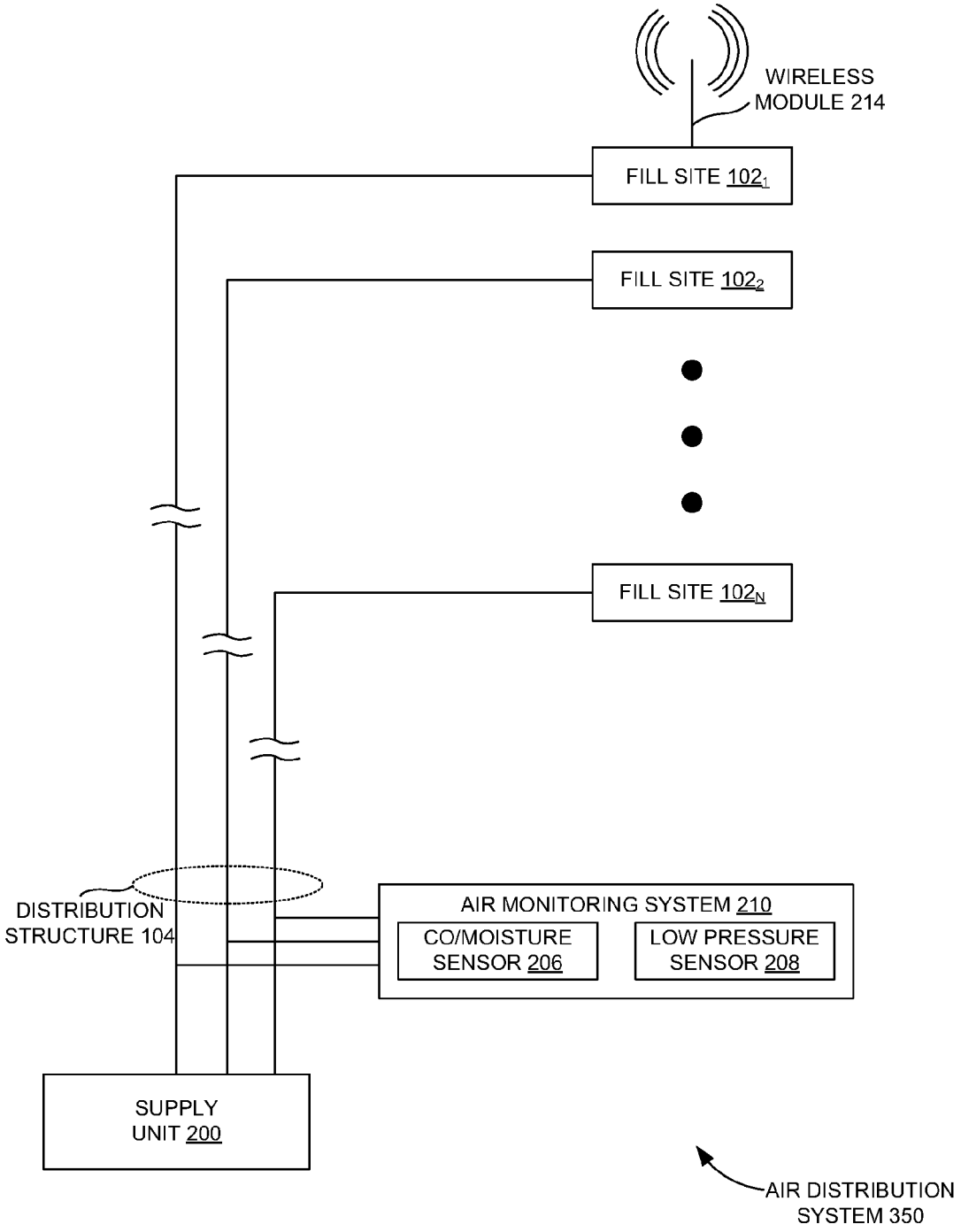

FIG. 2-3 are system views of the air distribution system 250/350, according to one or more embodiments. FIG. 2-3 illustrates different versions of the air distribution systems of FIGS. 1A, 1B and 1C, according to one embodiment. Particularly, FIG. 2 illustrates the fill sites $\mathbf{102}_{1\text{-}N}$ coupled to the distribution structure 104, supply units $\mathbf{200}_{1\text{-}M}$, and an air monitoring system 210, according to one or more embodiments. The fill sites $\mathbf{102}_{1\text{-}N}$ as described in FIGS. 1A, 1B, 1C may be designed for civilian use, military personnel use and/or for rescue staff use. In one or more embodiments, fill sites $\mathbf{102}_{1\text{-}N}$ may be supplied with compressed breathable air from the supply units $\mathbf{200}_{1\text{-}N}$ of air supply system 130. In one or more embodiments, the quality of the breathable air and the pressure in the air distribution system may be monitored by the air monitoring system 210.

In one or more embodiments, there may be single channel coupling one or more supply units $\mathbf{200}_{1\text{-}N}$ and the fill sites $\mathbf{102}_{1\text{-}N}$ as illustrated in FIG. 2 or there may be an individual line from the supply unit 200 to each of the fill site $\mathbf{102}_{1\text{-}N}$ as illustrated in FIG. 3. In one or more embodiments, the air monitoring system 210 may include a CO/moisture sensor 106, and a low pressure sensor 108. The CO/moisture sensor 106 of the air monitoring system 210 in the distribution structure 104 may be used to detect contamination of breathable air in the air supply system 130. In one or more embodiments, when the contamination is detected, the breathable air dissemination to the particular fill site may be automatically suspended by blocking one or more valves that are relative to point at which contamination occurs, when the contamination exceeds a safety threshold. Also, the pressure sensor 208 of the air monitoring system may be configured to detect low pressure in the distribution structure 104. In one or more embodiments, when low pressure in the distribution structure 104 is detected, the supply unit 200 may be configured to boost the pressure level to a prescribed pressure.

In one or more embodiments, each of the fill sites $\mathbf{102}_{1\text{-}N}$ may be configured to trigger an alarm when there is a compromise in breakable enclosure to alert security and rescue staff about an emergency in the marine vessel. In addition to alarm, each of the fill sites $\mathbf{102}_{1\text{-}N}$ may include a wireless module $\mathbf{214}_{1\text{-}N}$ configured to communicate an alert to security, rescue staff and other remote staff (e.g., coast guards).

Figure 4:
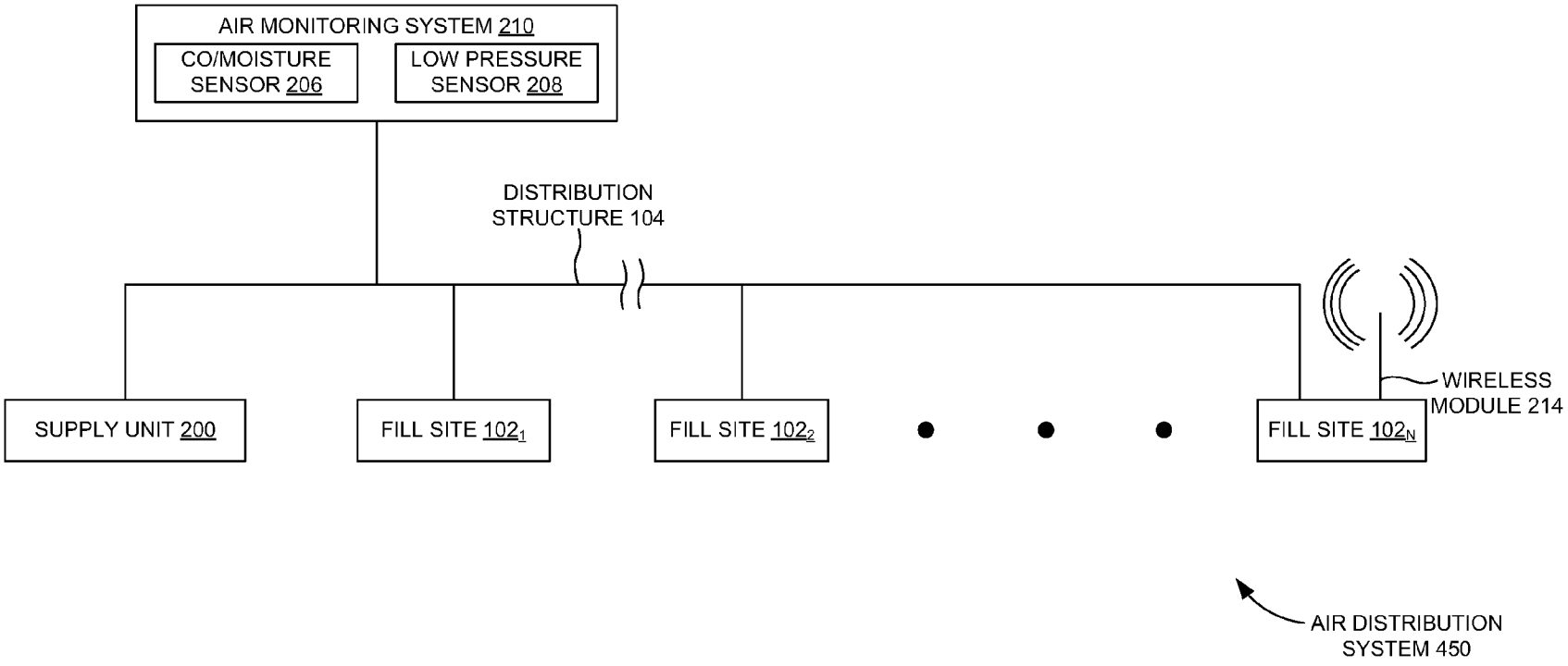
FIG. 4 is an alternate system view of the air distribution system illustrated in FIG. 1-3, according to one or more embodiments.

FIG. 4 is an alternate system view of air distribution system 450 illustrated in FIG. 1-3, according to one or more embodiments. Each air distribution system (e.g., the air distribution system 250, 350 and 450) may be used in conjunction with one another depending on the particular architectural style of the marine vessel 150 structure in a manner that provides most efficient access to the breathable air of the air distribution system reliably.

FIG. 5A is a front view of a supply unit 200, according to one or more embodiments. In particular, FIG. 5A illustrates status and controls of the air distribution system. In one or more embodiments, the supply unit 200 may be configured provide an access of a source of compressed air (e.g., the air supply system 130 of FIGS. 1A, 1B, and 1C) from the air distribution system (e.g., the air distribution system 250, 350, and/or 450). In one or more embodiments, the supply unit 200 may include a fill pressure indicator 500, a fill control knob 502, a system pressure indicator 504, and/or a connector 506. In one or more embodiments, the fill pressure indicator 500 may be configured to indicate the pressure level at which breathable air is being delivered by the source of compressed air to the air distribution system. In one or more embodiments, the system pressure indicator 504 may be configured to indicate the current pressure level of the breathable air in the air distribution system. In one or more embodiments, the fill control knob 502 may be designed to enable control the fill pressure such that the fill pressure does not exceed a safety threshold for which the air distribution system is designed.

In one or more embodiments, the connector 506 may be a RIC/UAC connector that is compatible with an air outlet of the source of compressed air of various emergency agencies (e.g., fire station, law enforcement agency, medical provider, and/or SWAT team, etc.). In one or more embodiments, the connector 506 of the supply unit 200 may be configured to facilitate a connection with the source of compressed air through ensuring compatibility of the supply unit 200 with the source of compressed air.

In one or more embodiments, the supply unit 200 may include an adjustable pressure regulator of the supply unit 200 that is used to adjust a fill pressure of the source of compressed air to ensure that the fill pressure does not exceed the design pressure of the air distribution system. Further, the supply unit 200 may also include a pressure gauge of the supply unit enclosure 508 to indicate the system pressure (e.g., the system pressure indicator 504) of the air distribution system and the fill pressure (e.g., the fill pressure indicator 500) of the source of compressed air. In one or more embodiments, the supply unit enclosure 508 may be a fragile cover coupled to an electronic system to raise an alarm when compromised.

FIG. 5B is a rear view of the supply unit 200, according to one or more embodiments. The supply unit 200 may include a series of valves 510 (e.g., a valve, an isolation valve, and/or a safety relief valve, etc.) to further ensure that system pressure is maintained within a safety threshold of the design pressure of the air distribution system. In one or more embodiments, the supply unit 200 may include a series of valves 510 (e.g., the valve, and/or the safety relief valve, etc.) to prevent a leakage of the breathable air from the air distribution system potentially leading to loss of a system pressure. For example, the supply unit 200 may include a series of valves 510 to automatically release breathable air from the source of compressed air (e.g., supply unit 200 of the air supply system 130) to the air distribution system when useful. The safety relief valve of the supply unit 200 and/or the fill site $102_{1-N}$ may release breathable air when a system pressure of the air distribution system exceeds a threshold value beyond the design pressure to ensure reliability of the air distribution system through maintaining the system pressure such that it is within a pressure rating of each component of the air distribution system.

Figure 6:
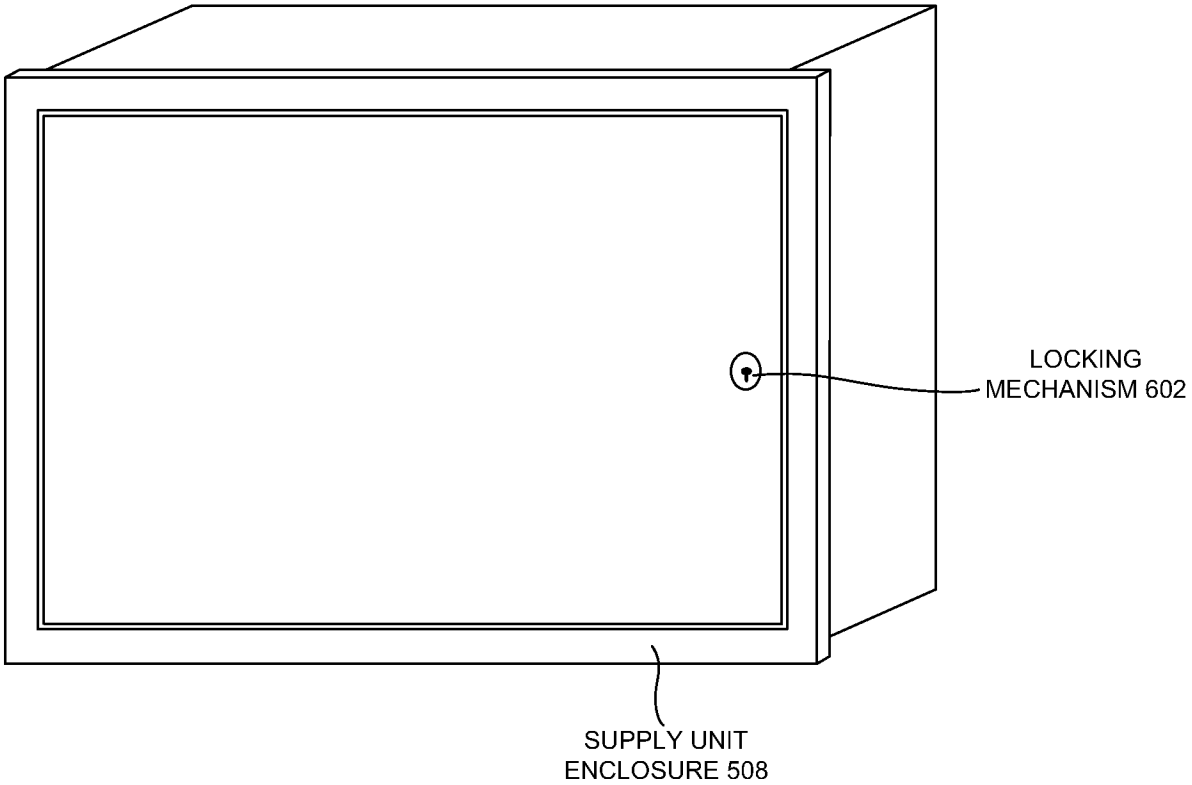
FIG. 6 is an illustration of a supply unit enclosure, according to one or more embodiments.

FIG. 6 is an illustration of a supply unit enclosure 508, according to one or more embodiments. In one or more embodiments, the supply unit enclosure 508 may include a locking mechanism 602 to secure the supply unit 200 from unauthorized access. Further, the supply unit enclosure 508 may also contain fire rated material such that the supply unit 200 is able to withstand elevated temperatures.

The supply unit enclosure 508 encompassing the supply unit 200 may have a weather resistant feature, ultraviolet and/or infrared solar radiation resistant feature to prevent corrosion and physical damage. The locking mechanism 602 may secure the supply unit from intrusions that potentially compromise safety and reliability of the air distribution system. In addition, the supply unit enclosure 508 may include a robust metallic material to minimize a physical damage due to various hazards to protect the supply unit 200 from any of an intrusion and damage. The robust metallic material may be substantially 18 gauge carbon steel. The supply unit enclosure 508 may include a visible marking to provide luminescence in a reduced light environment. In one or more embodiments, the locking mechanism 602 may also include a tamper switch such that an alarm is automatically triggered and a signal is communicated to any of a relevant administrative personnel, the security personnel and the emergency supervising staff of the marine vessel 150 from an intrusion of any of the supply unit 200.

FIG. 7A is an illustration of a fill station 102A, according to one or more embodiments. In particular, the fill station 102A illustrates an emergency support system that is designed for the use of a rescue staff for filling up breathable air apparatus storage. In one or more embodiments, the fill station 102A may be one of a type of fill site $102_{1-N}$ of FIG. 1. In one or more embodiments, the fill station 102A may include a system pressure indicator 700, a regulator 702, a fill pressure indicator 704, another fill pressure indicator 706, and a fill control knob 708. In one or more embodiments, the fill station 102A may also include a connector (e.g., a RIC/UAC connector) and multiple breathable air apparatus holders 712 used to supply air from the air distribution system. In one or more embodiments, the fill pressure indicators 704-706 may be configured to indicate the pressure level at which breathable air is being delivered by the source of compressed air to the air distribution system. The system pressure indicator 700 may be configured to indicate the current pressure level of the breathable air in the air distribution system. In one or more embodiments, the fill control knob 708 may be used to control the fill pressure such that the fill pressure does not exceed a safety threshold for which the air distribution system is designed. In one or more embodiments, the connector 710 may facilitate direct coupling to emergency equipment to supply breathable air through a hose that is connected to the connector. In essence, precious time may be saved because the emergency personnel may not need to spend the time to remove the emergency equipment from their rescue attire before they can be supplied with breathable air. Further, the connector 710 may also be designed to directly couple to a face-piece of a respirator to supply breathable air.

In one or more embodiments, the fill station 102A may be designed such that the multiple breathable air apparatus holders can hold multiple compressed air cylinders to be filled simultaneously. In addition, the multiple breathable air apparatus holders can be rotated such that additional compressed air cylinders may be loaded while the multiple compressed air cylinders are filled inside the fill station 102A. In one or more embodiments, the fill station 102A may be a rupture containment chamber such that over-pressurized compressed air cylinders are shielded and contained to prevent injuries. In one or more embodiments, a secure chamber of the fill station 102A may be designed as a safety shield that confines a possible rupture of an over-pressurized breathable air apparatus within the secure chamber. In one or more embodiments, the isolation valve may be automatically actuated based on an air pressure sensor of the air distribution system. In one embodiment, the fill station 102A may be designed to have enough space to enclose one or more breathable air apparatus and a connector (e.g., a RIC/UAC connector) to facilitate a filling of the breathable air apparatus. In one or more embodiments, the fill station 102A may also include a securing mechanism of the secure chamber of the fill station 102A having a locking function. In one or more embodiments, the fill station 102A may be automatically actuated via a coupling mechanism with a flow switch that indicates a status of air flow to the breathable air apparatus.

In one or more embodiments, the fill station 102A may include a fill pressure indicator 714 (e.g., pressure gauge), a fill control knob 716 (e.g., pressure regulator), a system pressure indicator 718, a number of connector 720 (e.g., RIC/UAC connector), and/or fill hoses 722. In one or more embodiments, the fill station 102A may also include a locking mechanism of a fill site enclosure 724 (e.g., fill panel enclosure) to secure the fill station 102A from intrusions that potentially compromise safety and reliability of the air distribution system. The system pressure indicator 718 may indicate the current pressure level of the breathable air in the air distribution system. The fill control knob 716 (e.g., pressure regulator) may be used to adjust the fill pressure such that the fill pressure does not exceed a safety threshold for which the air distribution system is designed.

In alternate embodiment, FIG. 7B illustrates a fill station 102B that is configured for the use of a civilian, according to one or more embodiments. In one or more embodiments, the fill station 102B may be another type of a fill site $\mathbf{102}_{1\text{-}N}$. In one or more embodiments, although, the fill station 102A may be different from the fill station 102B in construction and design, the function of the fill station 102A and the fill station 102B is to provide breathable air. In one or more embodiments, the connector 720 connected with the fill hoses 722 may be designed to directly couple to a face-piece of a respirator to supply breathable air to either emergency personnel (e.g., a fire fighter, a SWAT team, a law enforcer, and/or a medical worker, etc.) and/or stranded survivors in need of breathing assistance. In one or more embodiments, the fill station 102B may also be configured to enable a rescue staff to fill a self-contained breathable air apparatus. In one or more embodiments, each of the fill hoses 722 may have different pressure rating of the fill station 102B and may be coupled to any of a self-contained breathable air apparatus and respiratory mask having a compatible connector (e.g., RIC/UAC connector). In one or more embodiments, the fill site enclosure 724 may include a visible marking to provide luminescence in a reduced light environment.

FIG. 8A is a diagram view of a distribution structure 104 embedded in a fire rated material 802, according to one embodiment. In one or more embodiments, the distribution structure 104 (e.g., a piping structure) may be enclosed in the fire rated material 802. In one or more embodiments, the fire rated material may prevent the distribution structure 104 from damage in a fire such that an air distribution system may be operational for a longer time period in an emergency situation. Section 800 is a cross section of the distribution structure 104 embedded in the fire rated material 802.

FIG. 8B is a cross sectional view 800 of a piping structure embedded in a fire rated material 802, according to one embodiment. Section 800 is a cross section of the distribution structure 104 embedded in the fire rated material 802.

Figure 9:
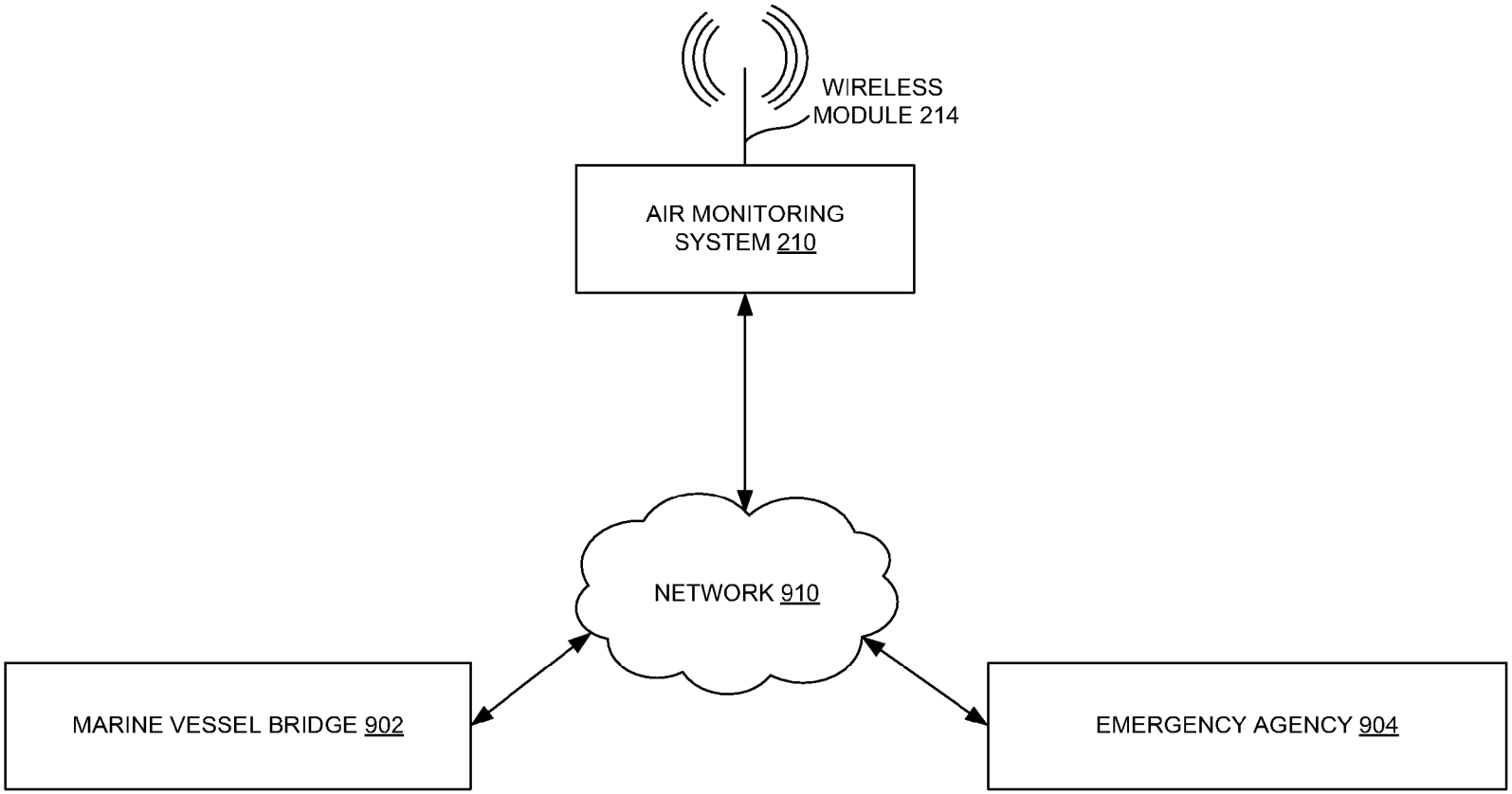
FIG. 9 is a network view of the air monitoring system with a wireless module that communicates with a marine vessel bridge and an emergency agency through a network, according to one or more embodiments.

FIG. 9 is a network view of an air monitoring system 210 with a wireless module 214 that communicates with a marine vessel bridge 902 and an emergency agency 904 through a network 910, according to one or more embodiment. In one or more embodiments, the air monitoring system 210 may include various sensors (e.g., the CO/moisture sensor 206 of FIG. 2, the pressure sensor 208 of FIG. 2, and/or hazardous substance sensor, etc.) and/or status indicators regarding system readiness information (e.g., system pressure, in use, not in use, operational status, fill site usage status, fill site operational status, etc.). In one or more embodiments, the air monitoring system 210 may communicate sensor readings to the marine vessel bridge 902 (e.g., the command room of the marine vessel) such that proper maintenance measures may be taken. In one or more embodiments, the air monitoring system 210 may be configured to communicate alerting signals as a reminder for regular system inspection and maintenance to the marine vessel bridge 902 through the network 910. Also, in one or more embodiments, the air monitoring system 906 may be configured to communicate sensor readings to the emergency agency 904 (e.g., coast guards, naval force and/or a hospital, etc.).

Figure 10:
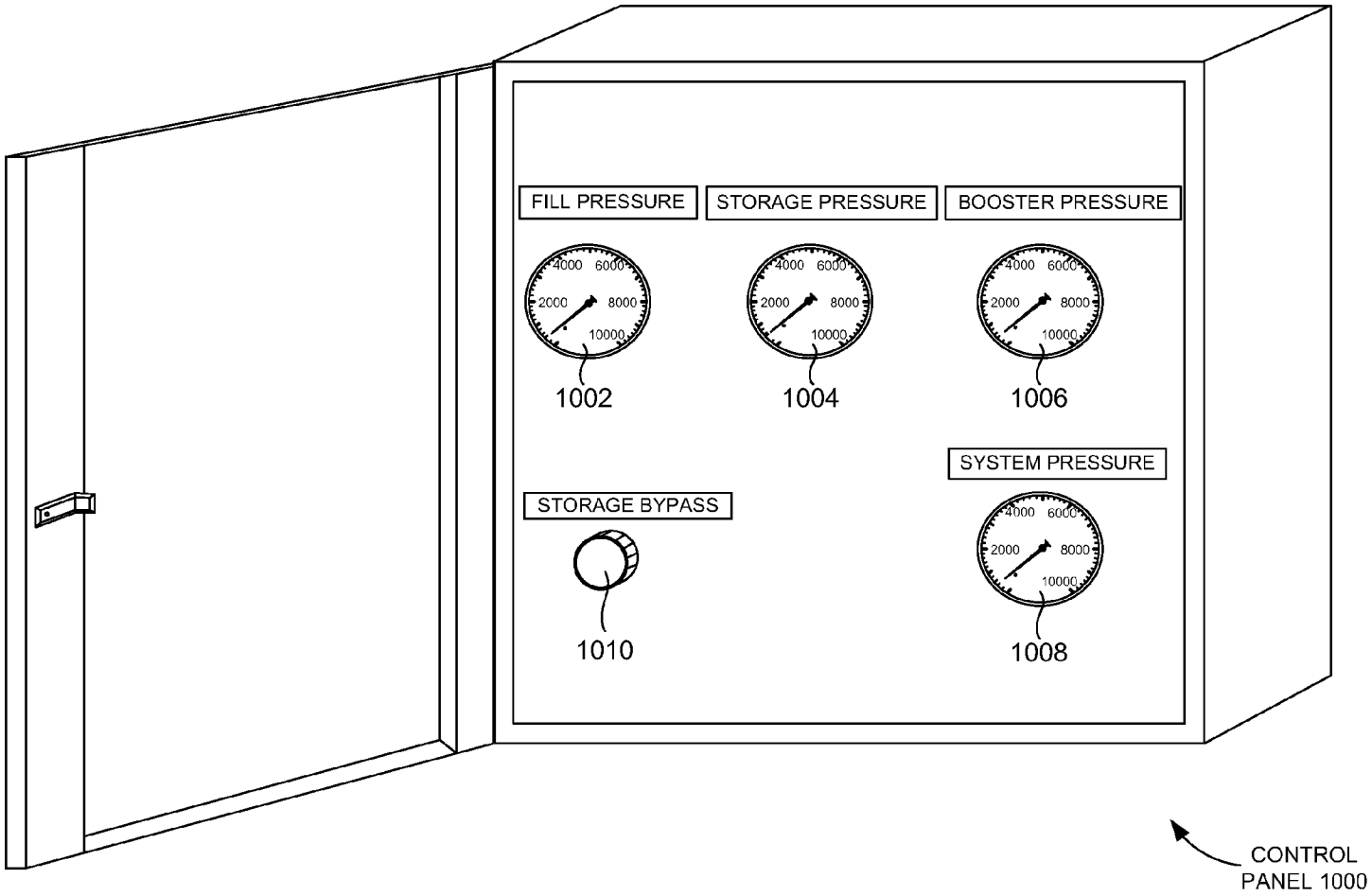
FIG. 10 is a front view of a control panel of an air storage sub-system, according to one or more embodiments.

FIG. 10 is a front view of a control panel 1000 of an air storage sub-system, according to one embodiment. In one or more embodiments, the storage sub-system may be a part of the air supply system 130 the air supply system 130 itself. In one or more embodiments, the control panel 1000 may include a fill pressure indicator 1002, a storage pressure indicator 1004, a booster pressure indicator 1006, a system pressure indicator 1008 and/or a storage bypass 1010. In one or more embodiments, the fill pressure indicator 1002 may indicate the pressure level at which breathable air is being delivered by the source of compressed air to the air distribution system. In one or more embodiments, the storage pressure indicator 1004 may be configured to display the pressure level of air storage tanks in the air storage sub-system. In one or more embodiments, the booster pressure indicator may be configured to display the pressure level of a booster cylinder. In one or more embodiments, the system pressure indicator 1008 may be configured to indicate the current pressure level of the breathable air in the air distribution system. Air may be directly supplied to the air distribution system through the storage bypass 1010.

Figure 11:
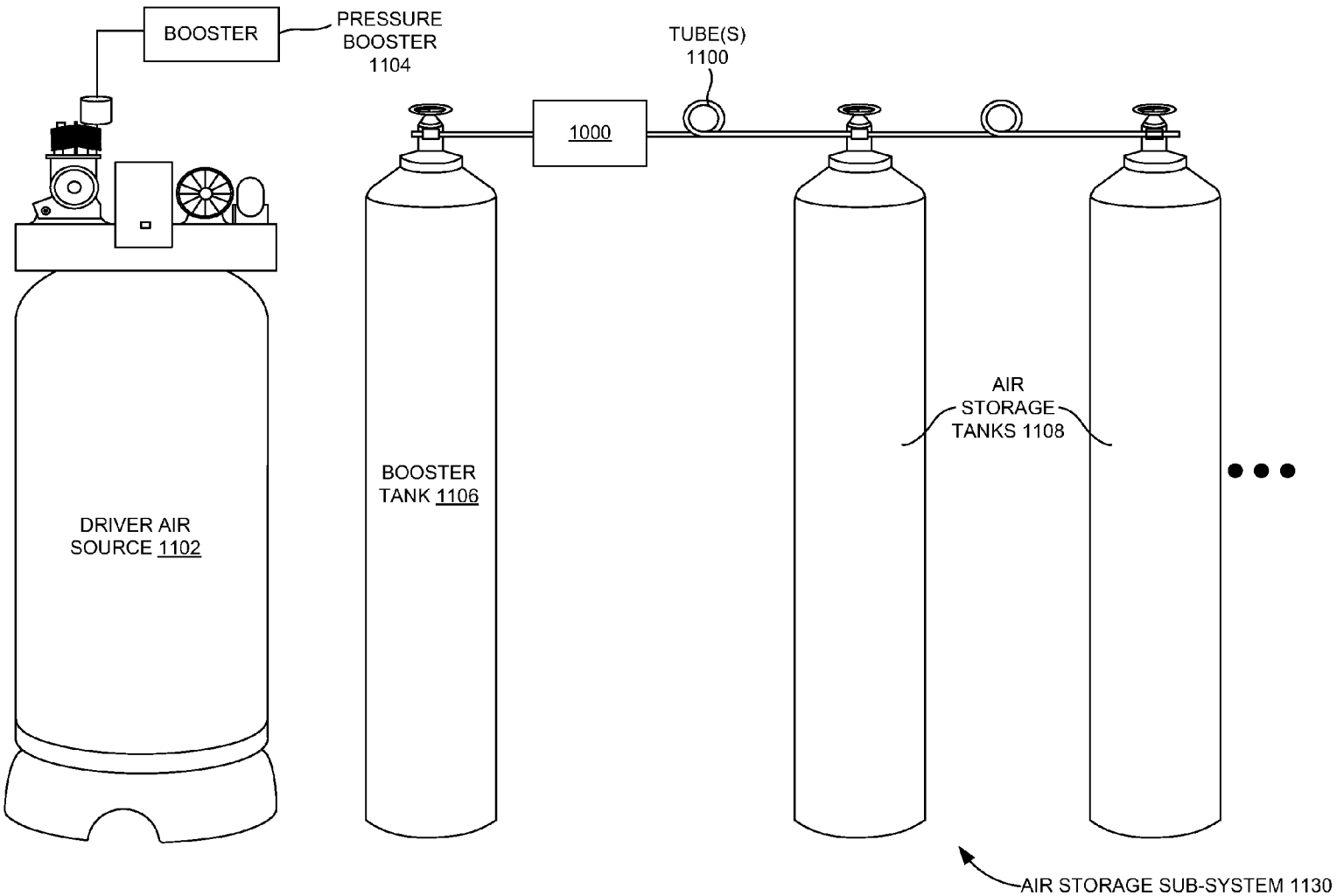
FIG. 11 is an illustration of an air storage sub-system, according to one or more embodiments.

FIG. 11 is an illustration of the air storage sub-system 1130, according to one or more embodiments. In one or more embodiments, the air storage sub-system 130 may include a control panel 1000, tubes 1100, a driver air source 1102, a pressure booster 1104, a booster tank 1106, and/or any number of air storage tanks 1108. In one or more embodiments, the control panel 1000 may be configured to provide status information regarding the various components of the air storage sub-system 1130. The tubes 1100 may couple each of the air storage tanks 1108 to one another in a looped configuration to increase robustness of the tubes 1100. In one or more embodiments, the driver air source 1102 may be configured to pneumatically drive the pressure booster 1104 to maintain a higher pressure of the air distribution system such that a breathable air apparatus is reliably filled. In one or more embodiments, the booster tank 1106 may store air at a higher pressure than the air stored in the air storage tanks 1108 to ensure that the air distribution system can be supplied with air that is sufficiently pressurized to fill a breathable air apparatus.

In one embodiment, the air storage sub-system 1130 may include air storage tanks 1108 to store air that is dispersible to multiple locations of the building structure. The number of air storage tanks 1108 of the air storage sub-system 1130 may be coupled to each other through tubes 1100 having a looped configuration to increase robustness of the tubes 1100 to prevent breakage due to stress. In addition, a booster tank (e.g., the booster tank 1106) of the air storage sub-system 1150 may be coupled to one or more air storage tanks to store compressed air of a higher pressure than the compressed air that is stored in the air storage tanks 1108. In one or more embodiments, a driver air source 1102 of the air storage sub-system 1130 may be coupled to a pressure booster (e.g., the pressure booster 1104) to pneumatically drive a piston of the pressure booster to maintain a higher pressure of the air distribution system such that a breathable air apparatus is reliably filled.

Figure 12:
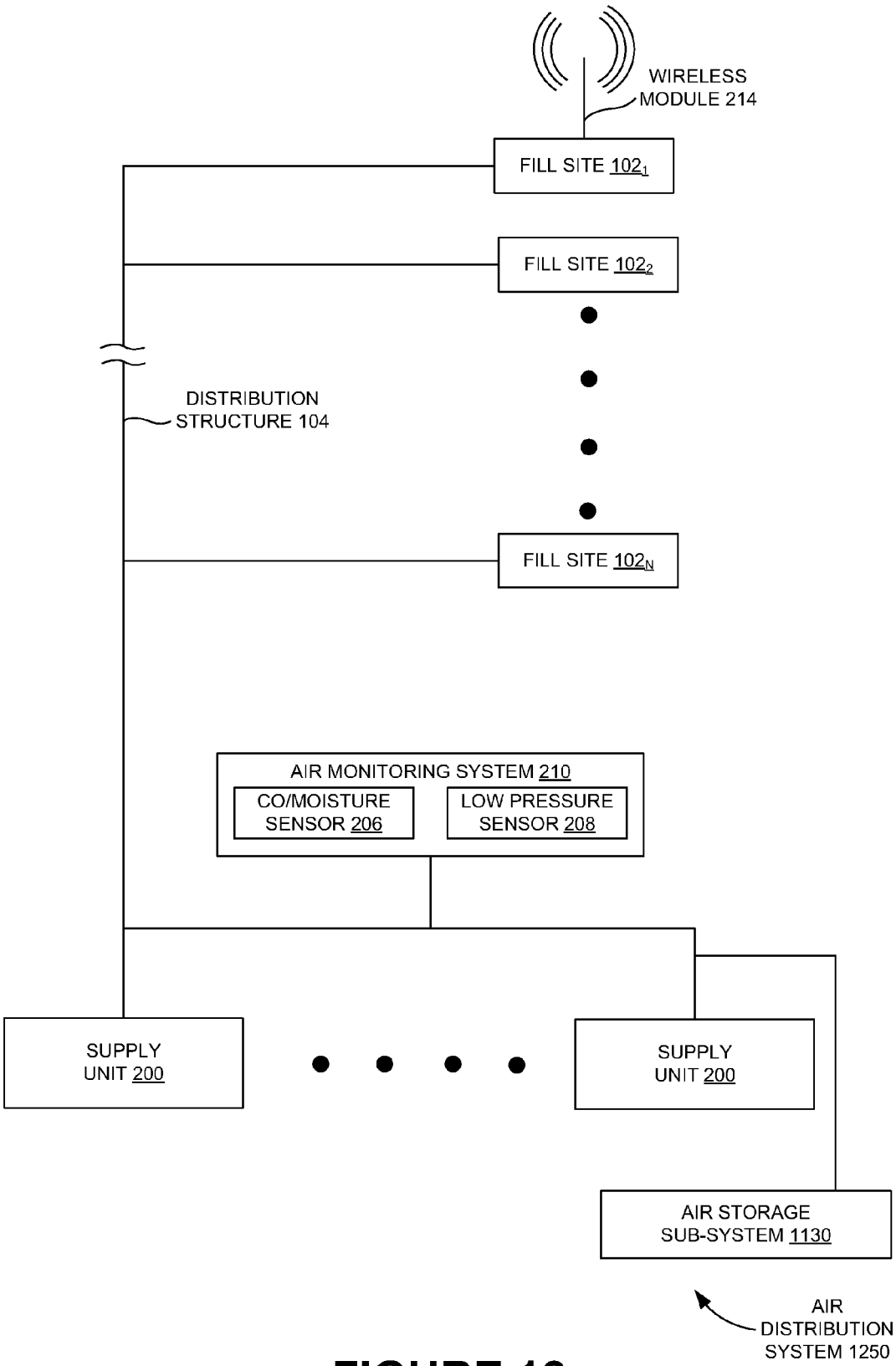
FIG. 12 is a diagram of an air distribution system having an air storage sub-system, according to one or more embodiments.

FIG. 12 is a diagram of an air distribution system 1250 having an air storage sub-system 1130, according to one embodiment. The air distribution system 1250 may include a number of supply units 200, a number of fill sites 102 that are coupled to the air distribution system through a distribution structure 104. In one or more embodiments, the air distribution system may also be configured to include the air storage sub-system 1130. The air storage sub-system 1130 is as previously described in FIG. 11. Air storage tanks 1108 and/or a booster tank 1106 of the air storage sub-system 130 of FIG. 11 may be supplied with breathable air through a source of compressed air that is coupled to the air distribution system through the supply unit 200 and/or supplied independently of the supply unit 200. The air storage sub-system 1130 may provide a spare source of breathable air to the air distribution system in addition to an external source of compressed air.

Figure 13A:
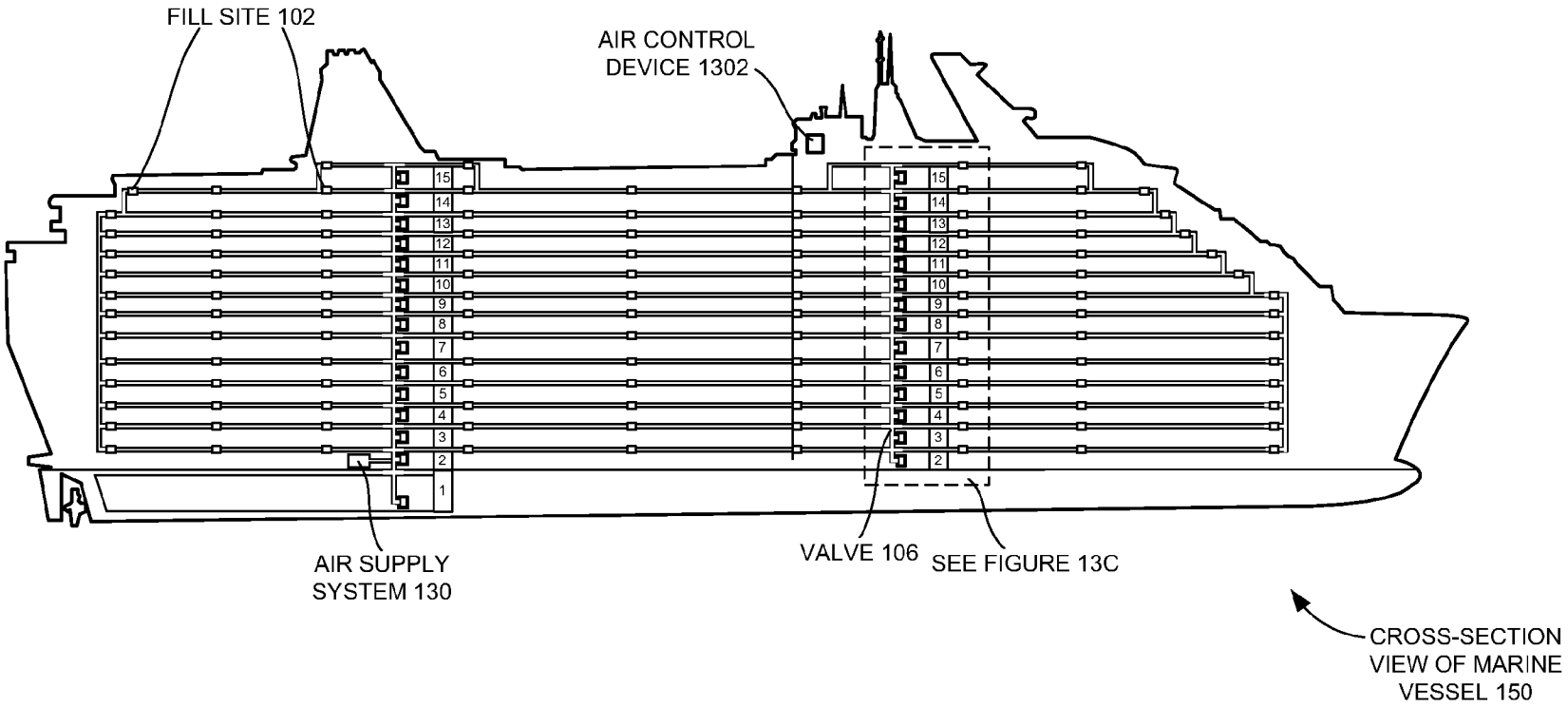
FIG. 13A is a cross-section view of marine vessel with an air distribution system configured to distribute breathable air through a distribution structure of a marine vessel, according to one or more embodiments.
Figure 13B:
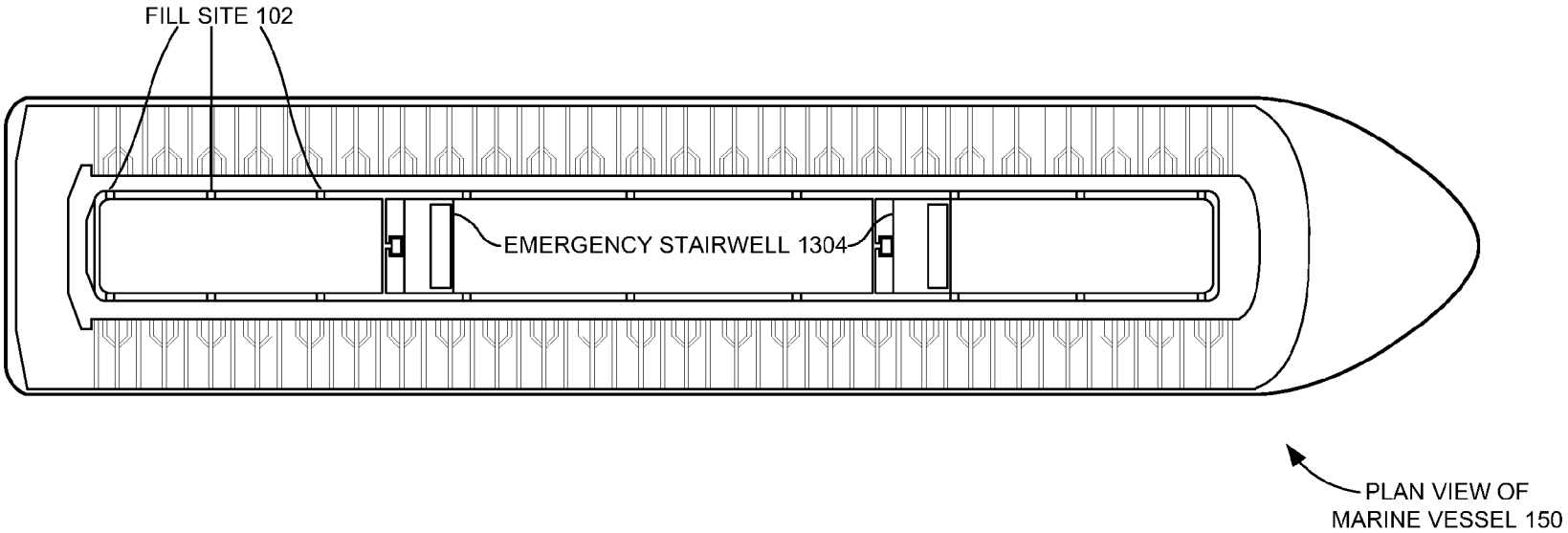
FIG. 13B is a plan view of marine vessel with an air distribution system configured to distribute breathable air through a distribution structure of a marine vessel, according to an example embodiment.
Figure 13C:
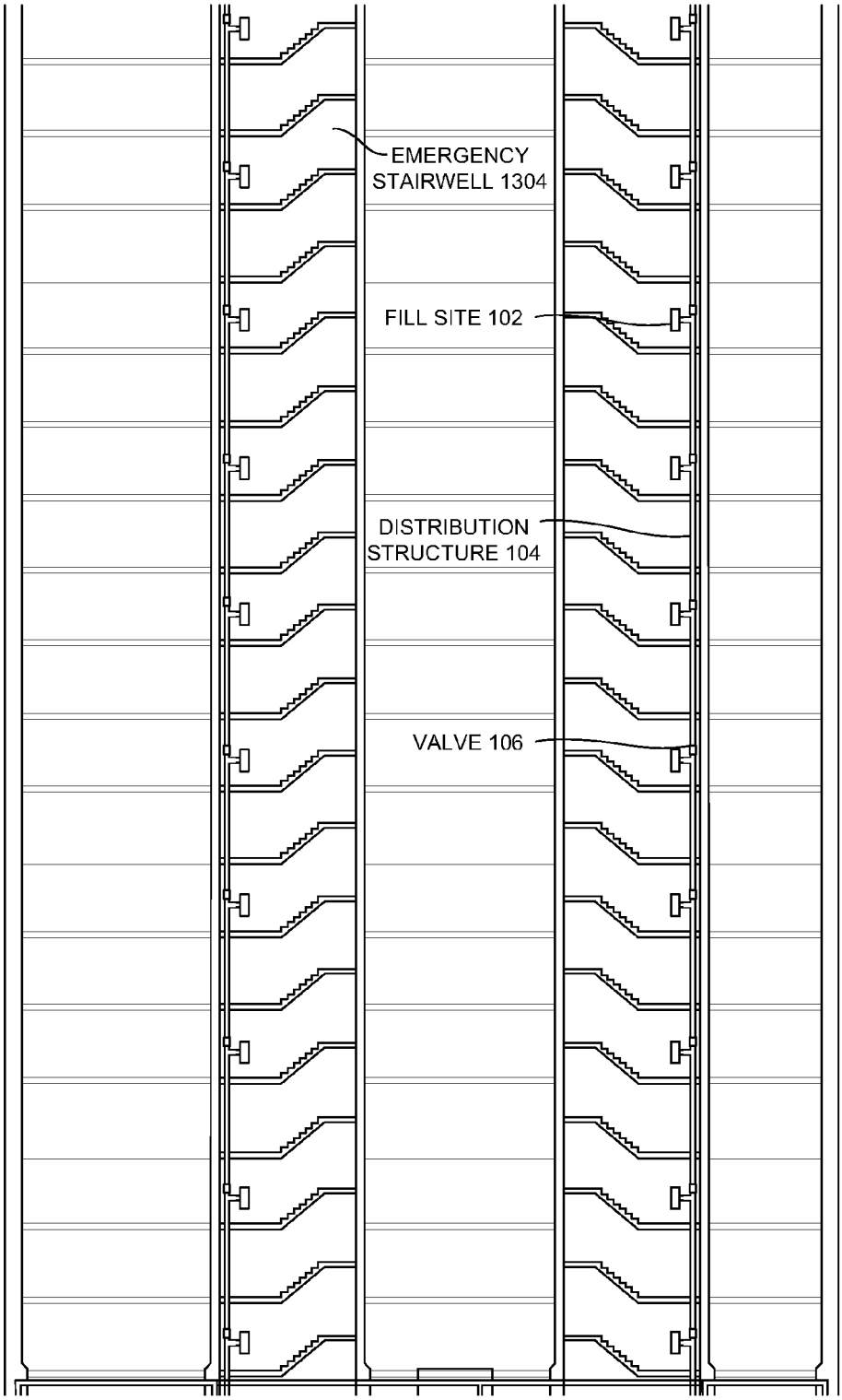
FIG. 13C is an insert view of marine vessel with an air distribution system configured to distribute breathable air through a distribution structure of a marine vessel, according to an example embodiment.

FIGS. 13A-C illustrate example views of marine vessel 150 with an air distribution system configured to distribute breathable air through a distribution structure of a marine vessel, according to one or more embodiments. The marine vessel 150 may include a fill site 102, an air supply system 130, and a valve 106. Additionally, the air control device 1302 may centrally regulate and/or monitor the breathable air supply throughout the marine vessel 150. The air control device 1302 may permit a user to remotely control a valve 106 such that the user may regulate the breathable air supply of the marine vessel 150 from a central location. The marine vessel 150 may include an emergency stairwell 1304 to facilitate evacuation of persons onboard the marine vessel 150.

In an embodiment, a safety system of a structure may include a fill (e.g., supply, put, add, spread throughout, make full, etc.) station (e.g., a location along a route, an apparatus with special equipment, a place to load and/or unload, etc.). The fill station may include a mechanism to add air to an air tank of a Self Contained Breathing Apparatus (SCBA) unit within a secure (e.g., free from danger and/or injury, dependable, unlikely to fail, etc.) chamber (e.g., a compartment, an enclosed space, a cavity, etc.). The secure chamber may act as a safety shield (e.g., a protective barrier to prevent injury and/or avert danger, a structure to prevent escape, etc.) that confines (e.g., to close within bounds, prevent from leaving, limit, etc.) a possible rupture (e.g., explosion, fragmentation, disintegration, etc.) of an over-pressurized breathable air apparatus (e.g., a SCBA air tank, etc.) within the secure chamber.

The fill station may therefore prevent injury or death from an exploding air cylinder by using a structure that substantially encloses the air cylinder on all sides, that restricts a fill operation to when the enclosure is closed and locked, and/or that substantially prevents air tank fragments above a threshold size from emerging from the enclosure. The fill station may also include a structure that is capable of withstanding shrapnel, that uses a locking mechanism to enclose the air tank within the structure, and/or that includes a cylinder rotational mechanism allows simultaneous connection and disconnection of air cylinders while cylinders are being filled internally. The walls of the secure chamber may be made of a continuous material, welded, bolted, and/or attached in any other means required to sustain forces associated with an explosive venting of compressed gas. The secure chamber of the fill station may also be required to meet a certification standard.

An open-circuit rescue or firefighter SCBA may include various components, including a full-face mask, regulator, air cylinder, cylinder pressure gauge, and a harness with adjustable shoulder straps and waist belt that allows it be worn on a user's back. Air cylinders for SCBA may be made of aluminum, steel, and/or a composite construction (e.g., carbon-fiber wrapped.) The composite cylinders may be the lightest in weight, which may make them preferred by fire departments. However, they may also have the shortest lifespan out of various types of air cylinders, and they may be taken out of service after 15 years. The air cylinder may come in one of three standard sizes: 30, 45 or 60 minutes of breathing time. Cylinders may be filled to a standard pressure rating (e.g., 3000 psi, 4500 psi, etc.) of several thousand pounds per square inch. While many cylinders may be used repeatedly and safely with proper maintenance and inspection, some air cylinders have explosively ruptured in the past, causing injury and/or death.

Testing may include a visual inspection in which a tank's interior is checked for corrosion, particulate, and/or any other abnormalities. The threads may be checked for integrity and/or imperfections. On aluminum tanks, a special electronic device may be used to check a cylinder's neck threads for cracking (e.g., stress cracks). An annual or more frequent inspection by an experienced technician may be needed to detect hazardous cracking before the cylinder becomes likely to fail. Untrained technicians may be unable to identify features associated with air cylinder inspections (e.g., a valley, a fold, a tap stop, etc.). Untrained technicians may also be unaware of how many threads may be safely penetrated before a cylinder must be discarded.

Air cylinders may further be required to undergo regular hydrostatic testing (e.g., every 3 years for composite cylinders, every 5 years for metal cylinders). A hydrostatic test is the common way in which leaks and/or flaws can be found in pressure vessels such as a gas cylinder. During hydrostatic testing, an air cylinder may be filled with a nearly incompressible liquid (e.g., water, oil, etc.) and examined for leaks or permanent changes in shape. Red or fluorescent dye may be usually added to the water to make leaks easier to see. The test pressure may be considerably higher than the operating pressure to give a margin for safety, typically 150% of the design pressure. For example, a cylinder rated to DOT-2015 PSI may be tested at around 3360 PSI to ensure maximum usage and to provide more safety. Water may be commonly used because it is almost incompressible, and it may only expand by a very small amount in the event of an air cylinder rupture. If high pressure gas were used, then the gas may expand to several hundred times its compressed volume in an explosion, which may cause substantial damage and/or injury, including dismemberment and/or death.

During the process of being filled with compressed air to its rated pressure (e.g., 3000 to 4500 psi), an air cylinder may become over pressurized (e.g., filled to a pressure beyond its ability to maintain structural integrity). The air cylinder may possess a reduced capacity to maintain a rated pressure due to a manufacturing defect such as an air pocket, a scratch, a dent, and/or any other imperfection that may result in a stress concentrator and/or crack initiation site. Manufacturing defects may further include materials imperfections (e.g., improperly tempered metals, impurities that make a material more brittle and/or weaker, improperly bonded and/or formed composite structures, etc.) Air cylinders may further include damage due to improper maintenance, accidental impacts, water damage, temperature induced stress, oxidation, and radiation effects. For example, structures such as air cylinders that undergo significant changes in temperature may undergo thermal stresses as different parts of the structure expand and contract. Radiation damage may include degradation of a composite bonding material. Oxidation may include rusting of a steel structure. Composite structures may undergo other forms of chemical alteration that result in a weakened structure over time. In addition, metallic structures may have a limited fatigue-failure life cycle. An air cylinder may therefore also become weakened over time through the ordinary course of wear and tear associated with aging.

Once initiated, cracks may propagate rapidly under changing stresses, such as those that occur during a filling operation. Should a rupture occur, an explosion may include a rapid multidirectional expansion of gas. Parts of an air cylinder may form shrapnel in an explosion. In a sufficiently high energy event, sheet metal may be punctured by shrapnel, doors and hinges may open, uncertified locks may become broken, and/or a person near an air cylinder that is rupturing may become seriously injured.

A fill station may therefore include a secure chamber that acts as a safety shield that confines a possible rupture of an over-pressurized breathable air apparatus (e.g., a SCBA air tank, etc.) within the secure chamber. The fill station may be rated to withstand an explosively decompressing air cylinder that has ruptured, to restrict the flow of emerging gasses to prevent harm to any nearby persons and/or equipment, and to enclose any shrapnel that may be accelerated due to an explosion. The secure chamber may be an opening within the fill station that allows filling to occur only when the structure has been closed and locked. The fill station may include a revolving structure to allow air cylinders to be mounted and unmounted while cylinders are filled within the locked secure chamber of the fill station. The revolving structure may include positions to mount two air cylinders at a time to be filled within the secure chamber. The locking mechanism may secure the revolving platform on all sides to provide sufficient support that the revolving platform will not allow shrapnel to emerge in the event of an explosion. The locking mechanism may visually indicate that the revolving structure has been secured and supported around its perimeter when the lock has been engaged.

In addition, the revolving mechanism may allow the fill station to maintain a constant pressure that fills an air tank within the secure chamber only when the locking mechanism has been engaged. In other words, unlocking the fill station may allow the filled air bottles to be disconnected from the system without a danger that air pressure will continue to be maintained in the lines connected to pressurized bottles.

Therefore, once air pressure to the system has been raised to an appropriate level (e.g., 3000 psi, 4500 psi, etc.), an operator of the fill station may add air to a cylinder by performing the steps of mounting an air cylinder to the fill station, rotating the revolving mechanism to enclose the air cylinder within the structure, and moving a lever to lock the station to allow air to flow into the air cylinders. The operator of the fill station may then move a lever to unlock the station, rotate the revolving mechanism to bring the air cylinder out from the enclosure, and unmount the filled air cylinder. Locking the fill station may provide structural support to the revolving mechanism to prevent air and shrapnel from escaping in an explosion, and may provide a visual indicator that the perimeter of the opening around the revolving mechanism has been closed. The walls of the secure chamber may be made of a continuous material, welded, bolted, and/or attached in any other means required to sustain forces associated with an explosive venting of compressed gas. The secure chamber of the fill station may also be required to meet a certification standard.

In an embodiment, a safety system of a structure may include a fill site system. A fill site system may include an apparatus that allows one or more firefighters to simultaneously refill an air tank of a Self Contained Breathing Apparatus (SCBA) unit while continuing to operate their breathing apparatus through the use of a specialized air connection (e.g., a rapid intervention company/crew (RIC) universal air connection (UAC), also described as the RIC/UAC coupling). The fill site may be a site (e.g., a location of a structure, a location within a building, etc.) to fill (e.g., supply, build up a level of, occupy the whole of, spread throughout, complete) a container with breathable air (e.g., compressed atmospheric gas meeting firefighting safety standards for quality and/or filtration) for emergency use. The specialized air connection may include a quick-connect system that allows the user to attach and/or detach the coupling without the use of a threaded connection.

In contrast, other methods and/or structures to refill an air tank of a SCBA unit may require a wearer to disconnect the air tank from the SCBA apparatus, connect the air tank to a mechanism to deliver compressed air into the air tank, and reinstall the air tank in the SCBA unit through a series of time consuming steps, during which the wearer of the SCBA unit may not have access to breathable air. The steps may involve screwing a connection together and unscrewing the connection using multiple turning actions. By allowing the wearer to continue to breathe while refilling an air tank of the SCBA unit, the wearer may avoid breathing excessive amounts of toxic, superheated and/or otherwise unbreathable air that may lead to immediate injury, long term health risks, unconsciousness, disablement, cancer, and/or death.

A SCBA unit may be a device worn by rescue workers, firefighters, industrial workers, and others to provide breathable air in a hostile environment. Areas in which SCBA may be used for industrial purposes may include mining, petrochemical, chemical, and nuclear industries. SCBA units designed for firefighting use may include components chosen for heat and flame resistance, which may add to a cost of manufacturing. Lighter materials may also be chosen to reduce the amount of effort needed by a firefighter to use the apparatus.

An open-circuit rescue or firefighter SCBA may include a full-face mask, regulator, air cylinder, cylinder pressure gauge, and a harness with adjustable shoulder straps and waist belt that allows it be worn on a user's back. Air cylinders for SCBA may be made of aluminium, steel, and/or of a composite construction (e.g., carbon-fiber wrapped.) The composite cylinders may be the lightest in weight, which may make them preferred by fire departments. However, they may also have the shortest lifespan out of various types of air cylinders, and they may be taken out of service after 15 years. Air cylinders may further be required to undergo hydrostatic testing (e.g., every 3 years for composite cylinders, every 5 years for metal cylinders). The air cylinder may come in one of three standard sizes: 30, 45 or 60 minutes of breathing time. The relative fitness, and the level of exertion of the wearer, may often result in a variation of the actual usable time that the SCBA can provide air. Working time during which a firefighter is not exposed to toxic gasses may be reduced by 25% to 50% based on these factors.

An SCBA may use a negative and/or positive pressure system to deliver breathable air. A "negative pressure" SCBA may be used with a standard face mask instead of filter canisters, and air may be delivered when the wearer breathes in, or in other words, reduces the pressure in the mask to less than external air pressure. One disadvantage of this method may be that any leaks in the device or the interface between the mask and the face of the wearer could result in a reduction of the protection offered by the SCBA. The wearer may inhale small and/or large quantities of polluted and/or toxic gas through such leaks. A "positive pressure" SCBA may be set to maintain a small positive pressure inside a face mask. Although the pressure may drop when the wearer inhales, the positive pressure SCBA may continue to maintain a higher positive pressure than external air pressure within the mask. The positive pressure may cause any leak in the mask to result, the device always maintains a higher pressure inside the mask than outside of the mask. Thus, even if the mask leaks slightly, there may be a flow of clean air out of the device that prevents inward leakage of external air.

Some potential sources of a leak in an SCBA system may be hair that prevents a complete seal of a face mask, an overly large size of a face mask, a face mask wrinkle, a face mask puncture and/or tear, a degraded seal between face mask components. Other causes of a leak may include a temporary dislocation of the face mask, such as through an accidental collision with another firefighter and/or a wall, a fall by a fatigued and/or disoriented wearer, or falling debris and/or structural components of a burning building. A wearer of the face mask may also enter a darkened building where electrical power has failed and/or been interrupted or where smoke makes it difficult for the wearer to see, which may contribute to accidental collisions. A face mask may further be dislodged by a building occupant being assisted by a firefighter.

The use of a specialized air connection (e.g., a RIC/UAC fitting and/or coupling) may allow an SCBA unit user to avoid a risk associated with breathing toxic gasses while an air cylinder is refilled by filling the SCBA unit cylinder while it is still connected to the SCBA unit as an operational source of breathable air. The RIC/UAC fitting connected to the fill site may therefore assist with expediting a breathable air extraction process from the air distribution system. The use of the specialized air connection may also avoid a risk of dislodging a user's mask and creating leaks in the SCBA system while the wearer refills an air cylinder. The specialized air connection may be a fitting designed to allow a direct transfer of air between fire fighters as a means of providing breathable air to a fire fighter without access to another means of refilling an air tank of an SCBA unit. The specialized air connection may further allow a fire fighter to provide air to a downed and/or disabled fire fighter who is unable to refill his own air tank. The specialized air connection may be a RIC/UAC coupling. The RIC/UAC coupling may allow two fire fighters with SCBA units to share their air regardless of manufacturer, after which the firefighters may have approximately equal levels of air. When a firefighter uses the RIC/UAC coupling to connect to another firefighter's SCBA unit, the pressure levels for each are balanced as air from an SCBA unit with more air flows to the connected SCBA unit.

A manufacturer of an SCBA unit may be required by the National Fire Protection Association (NFPA) 1981, the Standard on Open-Circuit Self-Contained Breathing Apparatus (SCBA) for Emergency Services, to build SCBA units that contain a RIC/UAC connection. The RIC/UAC coupling may be required for a newly manufactured SCBA unit to be in compliance for firefighting. The NFPA may be a U.S. organization that creates and maintains minimum standards and requirements for fire prevention and suppression activities, training, and equipment, as well as other life-safety codes and standards. This may include everything from building codes to the personal protective equipment utilized by firefighters while extinguishing a fire. State, local, and national governments may incorporate the standards and codes developed by the Association into their own law either directly or with only minor modifications. Even when not written into law, the Association's standards and codes may be accepted and recognized as a professional standard by a court of law.

NFPA may state in part that the RIC/UAC connection should allow a fully charged breathing air cylinder to connect to an SCBA unit of an entrapped and/or downed firefighter. The RIC/UAC coupling may be used in conjunction with a high pressure line. NFPA may further state that the pressurized air source should be able to provide 100 liters of air per minute using a RIC/UAC female fitting at a pressure compatible with the SCBA being used at an incident. NFPA may also state that, for newly manufactured SCBA, the universal connection (RIC/UAC) should be permanently fixed to the unit within four inches of the threads of the SCBA cylinder valve.

The fill site system may include variety of components to assist with expediting a breathable air extraction process from the air distribution system. For example, the fill site system may include a supply unit of a building structure to facilitate delivery of breathable air from a source of compressed air to an air distribution system of the building structure. The fill site may further include a valve to prevent leakage of the breathable air from the air distribution system potentially leading to loss of system pressure. The fill site system may further include a fill panel interior to the building structure having a RIC/UAC fitting pressure rated for a fill outlet of the fill panel to fill a breathable air apparatus to expedite a breathable air extraction process from the air distribution system and to provide the breathable air to the breathable air apparatus at multiple locations of the building structure. The system may further include a distribution structure that is compatible with use with compressed air that facilitates dissemination of the breathable air of the source of compressed air to multiple locations of the building structure.

The valve to prevent leakage of the breathable air from the air distribution system may be a part attached to a pipe and/or tube that controls the flow of a gas and/or a liquid. The valve may isolate the fill site from the remainder of the fill site system by preventing pressurized air from reaching the pressure gauge and the RIC/UAC fitting. Isolating the RIC/UAC fitting and pressure gauge may protect the parts from wear and/or possible damage due to fluctuating air pressures within the system. In addition, in the event of damage to and/or malfunction of the RIC/UAC fitting, pressure gauge and/or other connected parts, the valve may prevent the remainder of the system from venting gas through the damaged and/or malfunctioning part. The valve may be controlled by a turning knob placed in proximity to the pressure gauge to facilitate a control of the fill site station by a firefighter under hazardous conditions. Some potential causes of damage to the fill station may include a fire hazard, building damage, through a malfunction of a fire fighter's mating connection and/or SCBA unit.

The fill panel (e.g., a control panel of the fill site, a flat, vertical, area where control and/or monitoring instruments are displayed) may include gauges to monitor system air pressure and fill pressure. The valve to prevent leakage of the breathable air from the air distribution system may be controlled by a knob mounted on the fill panel. The fill panel may include a hose that is connected to the RIC/UAC fitting. The RIC/UAC fitting may be pressure rated (e.g., rated to 3000 psi, 4500 psi, etc.) for a fill outlet of the fill panel to fill a breathable air apparatus (e.g., a SCBA unit air cylinder, a SCUBA tank, etc.). The pressure rating may allow the RIC/UAC fitting to operate up to the rated pressure within a safety factor (e.g., 1.5, a multiple of the rated pressure) up to which the RIC/UAC fitting is designed and/or certified to operate.

As described above, the RIC/UAC fitting may expedite a breathable air extraction process from the air distribution system and to provide the breathable air to the breathable air apparatus. The expedited breathable air extraction process may take place at multiple locations of the building structure (e.g., different floors, hallways, near emergency exits, etc.). These locations may be near typical points where fire fighters and emergency workers may encounter while searching a building that is on fire. These locations may also be near emergency exits where building occupants are likely to pass by on their way out of a building, where they may obtain access to breathable air either directly or with the assistance of a fire fighter.

The system may further include a distribution structure that is compatible with use with compressed air that facilitates dissemination of the breathable air of the source of compressed air to multiple locations of the building structure. The distribution structure may include piping, pressure valves, and/or controls to regulate and/or direct pressurized air.

The system may include a supply unit enclosure that includes a weather resistant feature (e.g., to prevent lightning, wind, rain, and/or flooding damage, etc.). The system may include a supply unit enclosure to prevent corrosion and/or physical damage (e.g., power surges in electronic components) caused by ultraviolet, infrared, and/or other types of solar radiation (e.g., using a metallic shield, using lead, and/or a chemical coating). The system may further include a locking mechanism of the supply unit enclosure (e.g., to prevent tampering, vandalism, and/or thieves.)

The system may further include a fill panel enclosure to secure the fill panel from intrusions (e.g., due to falling building components, collisions with building occupants, etc.) that potentially compromise safety and reliability of the air distribution system. The supply unit enclosure may be comprised of 18 gauge carbon steel that minimizes physical damage due to various hazards by protecting the supply unit from intrusion and/or damage due to vehicle collisions, flooding, acid rain, snow, etc.

The system may further include a valve of the supply unit to perform any of a suspension of transfer and a reduction of flow of breathable air from the source of compressed air to the air distribution system when useful. The valve of the supply unit may therefore reduce a supply of air (e.g., an air pressure) to the distribution system when an excess pressure is provided by an external compressed air source. The valve of the supply unit may cut off an incoming air supply that fails to meet required purity standards for fire fighters. The valve may also reduce an incoming air supply that is being vented through a leak and/or malfunctioning valve of the system to prevent a waste of a compressed air source.

The system may further include a safety relief valve of any of the supply unit and the fill panel set to have an open pressure of at most approximately 10% more than a design pressure of the air distribution system to ensure reliability of the air distribution system through maintaining the system pressure such that it is within a threshold range of a pressure rating of each component of the air distribution system. The safety valve may prevent an overfilling of an air cylinder beyond its rated pressure capacity, which may cause the air cylinder to rupture. The safety valve may prevent a compressed air source from delivering air to hoses and/or fittings designed for lower pressures. The safety valve may prevent a rupture and/or other damage within the air delivery system caused by a spike in pressure. Some potential causes of a pressure spike may include a malfunctioning and/or improper pressure source, changes in temperature, and/or an explosion.

The system may further include any Compressed Gas Association (CGA) connector and/or RIC/UAC connector (e.g., a rapid intervention company/crew (RIC) universal air connection) to ensure compatibility and to facilitate a connection of the supply unit with a source of compressed air.

Although the present embodiments have been described with reference to specific example embodiments, it will be evident that various modifications and changes may be made to these embodiments without departing from the broader spirit and scope of the various embodiments. For example, the various devices and modules described herein may be enabled and operated using hardware circuitry, firmware, software or any combination of hardware, firmware, and software (e.g., embodied in a machine readable medium). For example, various electrical structures and methods may be embodied using transistors, logic gates, and electrical circuits. Accordingly, the specification and drawings are to be regarded in an illustrative rather than a restrictive sense.

What is claimed is:

1. A method of safety of a marine vessel, comprising:

affixing an emergency support system to the marine vessel;

pressurizing the emergency support system of the marine vessel to facilitate an air extraction process through the marine vessel;

expediting the air extraction process from the emergency support system by including a rapid fill fitting to a fill panel to fill a breathable air apparatus; and maintaining a prescribed pressure of the emergency support system such that a system pressure is compatible with the breathable air apparatus through a distribution structure that is rated for use with compressed air that couples a supply unit and the fill panel to transfer the breathable air of a source of compressed air to the fill panel.

2. The method of claim 1, further comprising:

ensuring that a prescribed pressure of the emergency support system maintains within a threshold range of the prescribed pressure by including a valve of the emergency support system to prevent a leakage of a breathable air from the emergency support system.

3. The method of claim 2, wherein:

the rapid fill fitting is a RIC (rapid interventions company/crew)/UAC (universal air connection) fitting.

4. The method of claim 3, further comprising:

distributing the fill panel within the marine vessel such that the fill panel is accessible in a compartment of the marine vessel and another fill panel is accessible in another compartment of the marine vessel.

5. The method of claim 4, further comprising:

safeguarding the distribution structure and the fill panel such that an exposure of one of a salt and water to the distribution structure is reduced to minimize one of a rusting and a corrosion of the distribution structure and the fill panel.

6. The method of claim 5, further comprising:

calculating a buoyancy of the marine vessel comprising an air supply system based on a density of the air supply system to ensure that the marine vessel comprising the air supply system is stable in a marine environment, wherein the air supply system is one of a breathable air compressor and an air storage sub-system.

7. The method of claim 6, further comprising:

securing the fill panel such that the fill panel remains coupled to the marine vessel during a vibration of the marine vessel, wherein the vibration is a rocking motion of the marine vessel in response to a wave of the marine environment.

8. The method of claim 7, further comprising:

automatically tracking and recording one of an impurity and a contaminant in the breathable air of the emergency support system through an air monitoring system.

9. The method of claim 8, further comprising:

automatically suspending an air dissemination to a fill site when one of an impurity level and a contaminant concentration exceeds a safety threshold.

10. The method of claim 9, further comprising:

tracking and recording the system pressure of the emergency support system through a pressure monitoring system.

11. The method of claim 10, further comprising:

enclosing the supply unit with a robust metallic material such that the supply unit is protected from a physical damage, wherein the robust metallic material is at least one of a substantially 18 gauge carbon steel and an at least 18 gauge carbon steel.

12. The method of claim 11, further comprising:

enclosing the supply unit with one of a weather resistant feature, an ultraviolet and an infrared solar radiation resistant feature to prevent the corrosion and the physical damage.

13. The method of claim 12, further comprising:

enclosing the distribution structure with one of a fire rated material and a fire rated assembly such that the distribution structure has ability to withstand an elevated temperature for a prescribed period of time; and protecting the fire rated material of the distribution structure through a sleeve, wherein the sleeve is at least three times an outer diameter of each of a plurality of pipes of the distribution structure.

14. The method of claim 13, further comprising:

suspending a transfer of the breathable air from the source of compressed air to the emergency support system through the valve of the distribution structure when the distribution structure is exposed to a threat to prevent a compromise of the distribution structure.

15. The method of claim 14, further comprising:

providing an air supply enclosure comprising a fire rated material and a breakable cover.

16. The method of claim 15, further comprising:

providing breathable air through the air supply enclosure when the breakable cover is compromised.

17. The method of claim 16, further comprising:

triggering an alarm when the breakable cover is compromised such that one of a security service and an emergency service is alerted.

18. The method of claim 17, further comprising:

providing a location in the marine vessel of the air supply enclosure to one of the security service and the emergency service.

19. A method of safety of a marine vessel, comprising:

affixing an emergency support system to the marine vessel;

pressurizing the emergency support system of the marine vessel to facilitate an air extraction process through the marine vessel;

safeguarding a filling process of a breathable air apparatus through an enclosure of the breathable air apparatus in a secure chamber of a fill station of the emergency support system of the marine vessel to provide a safe placement to supply a breathable air to the breathable air apparatus; and maintaining a prescribed pressure of the emergency support system such that a system pressure is compatible with the breathable air apparatus through a distribution structure that is rated for use with compressed air that couples a supply unit and a fill station to transfer the breathable air of a source of compressed air to the fill station.

20. A system comprising:

a marine vessel;

an air supply system coupled to the marine vessel to store a breathable air, wherein the air supply system is one of an air storage sub-system and an air compressor;

a fitting to expedite an air extraction process from a supply unit to fill a breathable air apparatus;

a fill panel to secure the fitting;

a distribution structure to connect the supply unit to the fitting; and a valve to maintain a prescribed pressure of an emergency support system such that a system pressure is compatible with the breathable air apparatus through the distribution structure that is rated for use with compressed air that couples the supply unit and the fill panel to transfer the breathable air of a source of compressed air to the fill panel.

* * * * *